US005927014A

United States Patent [19]

Goldenberg

[11] Patent Number: 5,927,014

[45] Date of Patent: Jul. 27, 1999

[54] DOUBLE LOCKING PIVOT SHOE

[75] Inventor: Shaul Goldenberg, 147 Carrington Dr., Richmond Hill, Ontario, Canada, L4C 7Z1

[73] Assignee: Shaul Goldenberg, Richmond Hill, Canada

[21] Appl. No.: 08/999,929

[22] Filed: Jun. 11, 1996

Related U.S. Application Data

[63] Continuation-in-part of application No. 07/677,135, Mar. 29, 1991, abandoned, which is a continuation of application No. 07/418,212, Oct. 6, 1989, Pat. No. 5,168,665, which is a continuation-in-part of application No. 07/287,327, Dec. 21, 1988, Pat. No. 4,888,915.

[30] Foreign Application Priority Data

Apr. 3, 1990 [CA] Canada ..... 2013774

[51] Int. Cl.[6] ..... E05D 15/22

[52] U.S. Cl. ..... 49/182; 49/184

[58] Field of Search ..... 49/174, 176, 177, 49/181, 453, 178, 179, 180, 182, 183, 184

[56] References Cited

U.S. PATENT DOCUMENTS

| | | | |
|---|---|---|---|
| 3,055,062 | 9/1962 | Peters et al. . | |
| 3,146,501 | 9/1964 | Peters . | |
| 3,184,784 | 5/1965 | Peters . | |
| 3,462,882 | 8/1969 | Brown . | |
| 3,842,540 | 10/1974 | Anderson . | |
| 3,844,066 | 10/1974 | Nobes . | |
| 4,068,406 | 1/1978 | Wood . | |
| 4,222,201 | 9/1980 | Yanessa | 49/174 |
| 4,364,199 | 12/1982 | Johnson et al. . | |
| 4,610,108 | 9/1986 | Marshik . | |
| 4,644,691 | 2/1987 | Wright | 49/181 |
| 4,718,194 | 1/1988 | Fitzgibbon et al. . | |
| 4,887,389 | 12/1989 | Haltof | 49/181 |
| 4,888,915 | 12/1989 | Goldenberg . | |

FOREIGN PATENT DOCUMENTS

| | | |
|---|---|---|
| 1195186 | of 0000 | Canada . |
| 2083118 | of 0000 | United Kingdom . |
| 91/15648 | of 0000 | WIPO . |

*Primary Examiner*—Peter M. Cuomo
*Assistant Examiner*—Gerald A. Anderson
*Attorney, Agent, or Firm*—Neil H. Hughes; Ivor M. Hughes; Marcelo K. Sarkis

[57] ABSTRACT

A shoe for movement in a track of a closure assembly the track having at least one engaging portion, the pivot shoe comprising a carrier portion having a bottom end for movement within the track, the shoe having clamping portions for clamping said at least one engaging portion of the track of the closure assembly the at least one engaging portion being disposed between the clamping portions of the shoe when the pivot shoe is installed in the closure assembly. The shoe also has an operating mechanism, the clamping portions being in engagement with said operating mechanism said operating mechanism being moveable from a first position to cause the clamping portions to engage the at least one engaging portion of the track wherein the closure member of the closure assembly is locked or secured in position, to a second position wherein the clamping portions disengages the at least one engaging portion of the track wherein the closure member of the closure assembly is free to move in the track.

11 Claims, 18 Drawing Sheets

DOUBLE LOCKING PIVOT SHOE

This is a continuation-in-part of application Ser. No. 07/677,135, now abandoned which is a C-I-P of application Ser. No. 07/418,212 filed Oct. 6, 1989 now U.S. Pat. No. 5,168,665 which is a continuation-in-part application of application Ser. No. 07/287,327 filed Dec. 21, 1988 now U.S. Pat. No. 4,888,915.

FIELD OF INVENTION

This invention relates to devices which allow the sliding and subsequent pivoting of a closure member from a locked position wherein in sliding of the closure member is allowed to a fully pivoted position where sliding of the member is prohibited. The invention is preferably embodied in a tilt slide window assembly.

This invention also relates to pivot shoes for closure assemblies and specifically to a pivot shoe with locks within a track or channel portion of a closure assembly.

BACKGROUND OF THE INVENTION

Double hung windows are well known in the art. There are a multiplicity of examples of such double hung windows which incorporate window frames and jamb guides located therein for the sliding of a window sash within the jamb guide. Further there are many examples within the prior art which allow for the sliding of a window sash within a frame within the jamb channels thereof which further incorporate a carrier or shoe attached to the window sash which allows for the pivoting of the window sash away from the window frame.

U.S. Pat. No. 4,610,108 describes such a device which incorporates a generally U-shaped spring member within a block, wherein a pin or strut extending from the windows sash is connected. A cam member is incorporated in the block member which is rotatably engagable with the U-shaped member to lock the block in position.

Another example of such a tiltable window sash is found in U.S. Pat. No. 3,844,066 wherein the block is further attached through the sash balance. The cam is incorporated in the block and a pin or strut is attached thereto for rotational pivoting of the window sash and the subsequent locking of the block in position.

U.S. Pat. No. 4,364,199 describes a similar type block as described above incorporated in a window jamb weather strip, whereby the slidable block is held fixedly in place with respect to the weather strut.

U.S. Pat. No. 4,718,194 describes a shoe or block for pivoting a sash and allowing the sliding thereof as well within the window jamb channel, wherein the window may be removed from the assembly while the lock and balance remain in place. This allows the insertion of the window when repaired without the nuisance and deterioration of the movement of the sash and block. Another example of an alternative structure which illustrates the multiplicity of cams and block assemblies found within the prior art is found with U.S. Pat. No. 4,683,676. The aforementioned reference describes a split shoe having a cam and stud or pivot assembly which allows for the ease of repair of the pivot block and portions thereof without providing for a special feature within a jamb channel of a window frame.

Canadian Patent 1,195,186 describes a typical shoe and sash assembly incorporating a spring member for gripping to the jamb channel when the cam is rotated. U.S. Pat. Nos. 3,146,501, 3,462,882, 3,184,784 and 3,055,062 illustrate alternative cam devices used within window frames.

U.K. Patent Application 2,083,118 describes a window assembly incorporating a pair of wheels within a sash frame to allow for the sash frame to more easily slide within the jamb channel.

U.S. Pat. No. 3,842,540 describes a two part cam and locking structure which attaches into the sash portions of the window assembly and allows for the pivoting and locking of a window assembly. However, the structure is not embodied to easily access the locking portion, being attached to the balance sash as best illustrated in the FIGS. 6 through 9 of the aforementioned Patent. When the window sash is pivoted away from the frame the handle portion does not disengage the window sash but provides for locking portions to lock the sash in a predetermined vertical position during tilting thereof.

Further within the prior art a tilt slider is manufactured and distributed by Canadian Thermo Windows, whose office is in Toronto, Canada, which provides sash assemblies and pivots therefor for sliding in a horizontal direction. A shoe or block is provided to allow for the sliding of the windows within a channel within the header and sill sections of the window frame. Pins extend from the block or shoe into the sash at the top and bottom of each window sash. The pins, pivot or struts as they are known in the art extend into a cam member which is rotatable when the sash is rotated in a direction away from the window frame and thus allows for the locking of the window frame in position. There is further incorporated in the shoe design a fastening device to fasten the pin or strut extending into the cam into the shoe or block to prevent the pin and hence window from falling out of the cam should the sash have a tendency under its weight to load the cam pin. It has been typically a problem to the operation of the window assembly to ensure the easy movement thereof and prevent the window sash from sagging when it is moved. It has been found that in operation the window sash will not always return to the same location for locking in that the, for example, top block or shoe may be advanced in position when the window is sagged and returned from its pivoted position and thus an opening to allow air to pass through may occur at the edge of the window when closed. Further the window incorporates latching means to latch the window in position for security purposes. Further locking means are provided which incorporate tongues which extend in a vertical position into the header and sill channels to prevent the window from pivoting and allow when unlocked to pivot the window. However such devices are typically recessed into the window sash at the edge thereof and are often difficult to operate.

Further within the prior art the aforementioned problems described above will generally occur when any pivot block provided on the edge of the window sash moves in relation to another pivot block. The only means for securing the sash of the window to the pivot block being either a pin or strut. The continuing motion and sliding of the windows back and forth and the pivoting thereof causes the windows to misalign and sag under the weight of gravity especially when manufactured in a vertical tilt slider. In order to overcome this problem an improved bracing system is sadly lacking within the prior art.

A multiplicity of designs for sliding patio doors further exist within the prior art. A typical patio door is made up of two framed main glass panels sliding in a horizontal direction but which do not typically pivot. The weight of the patio doors would require a substantial device in order to allow for the pivoting thereof, such hardware would further eliminate or minimize the door sagging out of position and the need for realignment of the doors when pivoted back to the closed position. The pivoting of patio doors would be quite attractive and would allow for the incorporation of French type doors in the industry. No such doors exist within the market place at the present time.

It is therefore an object of this invention to overcome all of the deficiencies in the prior art stated above which allows for smooth operation of a closure member which is capable of both sliding within a guide channel and tilting upon a pivot assembly thereof. Nowhere within the prior art is such a device provided which allow for the manufacture of heavier windows in larger sections without the sagging of the window and having reliable operating pivots incorporated in the block members which both allow for the pivoting and locking of the window by the user.

It is a further object of the invention to provide a reliable pivot shoe for use in relation to a guide channel disposed within a frame for a closure member whereby locking of the pivot shoe occurs almost immediately when the window or closure member is rotated.

It is a further object of this invention to provide a pivot shoe assembly which is interconnected to allow for the bracing of the closure member and the prevention of sag thereof.

Another one of the problems in the prior art especially when forming vinyl or plastic extrusion for framing portions of a closure assembly is is that there may be a distortion in the extrusion because of the tolerances of manufacture of the extrusion. For example, a typical extrusion has a track portion which has a height, a width and a length. One problem will occur when the overall width of the track differs along the length of the track resulting in a variation in the operation of a pivot shoe disclosed in the C.I.P. application 07/418,212 which is a continuation in part of Ser. No. 07/287,327 filed Dec. 21, 1988 claiming priority from a Canadian Application 577,393 filed on Sep. 14, 1988. The parent application has issued as U.S. Pat. No. 4,888,915.

Therefore, in constructing vinyl extrusions a pivot shoe as taught in the parent materials, clamps against the sides of the track but has a maximum ability to move the locking portions. The cam when rotating has a particular offset distance and the legs of the locking portions extending towards the side of the track an equivalent amount to that offset distance. Should however the vinyl extrusion have a significant variation in width from end to end in the dimension between the walls of the track, the pivot shoe and the locking thereof will work less effectively or in some instances may not work at all. For example, if the overall width of the shoe when the locking means are extended is 29.0 millimeters and the tolerance variation in the formation of the width of the extrusion is between 28.5 and 29.2 millimeters then the pivot shoe will operate loosely in some of the tracks and will not offer any braking what so ever over some of the track because the variation and the tolerances of the extrusion is outside of the ability of the pivot shoe.

Of course, the problem is discussed in relation to vinyl and plastic. This also is the case when forming an aluminium window or any structure in a window regardless of the material used as any structure will have a range of tolerance in manufacture.

Another problem experienced when using plastics such as vinyl with the pivot shoe substantially as taught in U.S. Pat. No. 4,888,915 is the flexing of the side walls under pressure from the locking portions of the pivot shoe. The flanges of the shoe flex sufficiently to deform the plastic track away from the action of the locking portions of the shoe and thus decrease the effectiveness of the braking action.

Most known closure assemblies for patio doors, sliding windows, doubled hung windows and the subject matter of U.S. Pat. No. 4,888,915 have tracks or channels within which a pivot shoe glides. Nowhere within the prior art is there found a pivot shoe which has clamping means which captures at least one flange of the track portion therebetween to provide the locking or securing functions of the pivot shoe.

It is therefore a primary object of this invention to provide a pivot shoe which includes clamping means which in use clamps at least one flange of the track portion of a closure assembly to provide the braking or securing of the pivot shoe within the track.

It is a further object of this invention to provide a pivot shoe which is lockable within a track of a closure assembly and includes operating means to do so.

Further and other objects of this invention will become apparent to a man skilled in the art when considering the following summary of the invention and the more detailed description of the preferred embodiments illustrated herein.

SUMMARY OF THE INVENTION

According to one aspect of the invention, there is provided a pivoting and sliding closure assembly comprising:

i) an opening extending in a peripheral frame said peripheral frame including a header portion, a sill portion and two vertically extending jamb portions ii) the sill and header portions or the two jamb portions having disposed therein or attached thereto track portions extending in a substantially parallel direction to the extensions of said peripheral frame portions ii) a) at least one closure member slidable within said track portions and pivotable proximate at least one end thereof and latchable proximate the other end thereof iii) each track portions having disposed therein at least two pivot shoes being interconnected by interconnecting means, each pivot shoe including a preferably substantially rectangular shaped carrier portion, the carrier preferably having rolling means disposed therein for assisting the movement of the pivot shoe, the carrier further having interconnecting portions therewith to interconnect with the interconnecting means (preferably lockable interconnecting means lockable in relation to said carrier) some of the carrier portions having disposed therein an opening wherein camming means are disposed, said camming means being moveable to cause locking means disposed with said pivot shoe to engage and lock the pivot shoe from sliding movement in the track portions iv) some of the camming means of some of the pivot shoes having engagement means therewith for engagement with pivot means of the at least one closure member to allow the at least one closure member to rotate when free to do so and upon rotation thereof to cause the camming means to rotate thus locking the locking means of the pivot shoe v) some of the camming means of some of pivot shoes having latching means engaged therewith for latching the at least one closure member having latch engaging means therewith to prevent the closure member from pivoting upon its pivot means when the closure member remains slidable with said track and which when disengaged locks the pivot shoe in position with respect to the track by engaging the locking means thereof vi) the at least one closure member being braced from sagging by the interconnecting means interconnecting the pivot shoes disposed in each track, the interconnecting means further preventing the pivot means from disengaging from the relevant pivot shoe when the at least one closure member is rotated to an open position.

According to another aspect of the invention, there is provided a pivoting and sliding window assembly comprising:

i) an opening extending in a peripheral frame said peripheral frame including a header portion, a sill portion and two vertically extending jamb portions ii) the sill and header portions or the two jamb portions having disposed therein or attached thereto track portions extending in a substantially parallel direction to the extensions of said peripheral frame portions ii) a) at least one window sash slidable within said track portions and pivotable proximate at least one end thereof and latchable proximate the other end thereof iii) each track portions having disposed therein at least two pivot shoes being interconnect by interconnecting means, each pivot shoe including a preferably substantially rectangular shaped carrier portion, the carrier preferably having rolling means disposed therein for assisting the movement of the pivot shoe, the carrier further having interconnecting portions therein to interconnect with the interconnecting means (preferably lockable interconnecting means lockable in relation to said carrier) some of the carrier portions having disposed therein an opening wherein camming means are disposed, said camming means being moveable to cause locking means disposed with said pivot shoe to engage and lock the pivot shoe from sliding movement in the track portions iv) some of the camming means of some of the pivot shoes having engagement means therewith for engagement with pivot means of the at least one window sash to allow the at least one window sash to rotate when free to do so and upon rotation thereof to cause the camming means to rotate thus locking the locking means of the pivot shoe v) some of the camming means of some of pivot shoes having latching means engaged therewith for latching the window sash having latch engaging means therewith to prevent the at least one window sash from pivoting upon its pivot means when the closure member remains slidable with said track and which when disengaged locks the pivot shoe in position with respect to the track by engaging the locking means thereof vi) the at least one window sash being braced from sagging by the interconnecting means interconnecting the pivot shoes disposed in each track, the interconnecting means further preventing the pivot means from disengaging from the relevant pivot shoe when the window sash is rotated to an open position.

According to yet another aspect of the invention there is provided for use in a pivoting and sliding closure assembly, a closure member (preferably a window sash) slidable within a guiding channel having outwardly extending flanges and pivotable therefrom, the closure member having a substantially rectangular frame having a top and bottom, and having engaged at its top and bottom proximate one end pivot means for engaging a first and second pivot shoe, and having disposed proximate the other end thereof proximate the top and bottom means for engaging a third and fourth pivot shoe, said pivot shoes slidable in said guiding channel and comprising a body having a top and bottom (preferably made from thermoplastic material) and having disposed proximate the bottom thereof at least one roller or wheel, said pivot shoes having disposed proximate one end thereof fastening means to fasten at least the first and third, and the second and fourth pivot shoes together by connecting means extending therebetween (preferably the connecting means being adjustable in length), each pivot shoe having a slot disposed proximate the end thereof remote the fastening means, said slot including an opening therein for a cam member, said slot and opening extending from proximate the top to proximate the bottom of said pivot shoe, said cam member being substantially cylindrical having a central axis and having camming means thereupon or upon the perimeter of the opening of said slot wherein a detent extends with said cam for engagement with the pivot means connected to the closure member for the first and second pivot shoe and a handle member for the third and fourth pivot shoe, said handle member having engagement means thereupon for engagement with the means for engaging the third and fourth pivot shoe of the closure member, the body having two legs, one on each side of the slot, having a clamping surface upon the surface of the body adjacent the outwardly extending flanges of the guide channel;

whereby when the handle member of the third and fourth pivot shoes are rotated the pivot means and the cam member rotate, and the two legs of the body move laterally away from the cam member urged by the camming means, the clamping surface thus engages the outwardly extending flanges of the guide channel thus locking the third and fourth pivot shoes in position in relation to said first and second pivot shoes, however rotation of the handle member disengages the means for engaging the third and fourth pivot shoes and the closure member, allowing the pivoting of the closure member upon the first and second pivot shoes upon the pivot means away from the guide channel, the closure member when pivoted causes the cam member of the first and second pivot shoe to rotate wherein the first and second pivot shoes are locked in position in the guide channel in identical manner to the third and fourth pivot shoe further prevented from movement under the weight of the closure member by the third and fourth pivot shoes locked and interconnected to the first and second pivot shoes.

According to yet another aspect of the invention the assembly may comprise third and fourth pivot blocks whose handles extend in a substantially horizontal direction from the extension of the vertical extending pivot pins when the guide channel in which the first and third pivot shoe and the guide channel in which the second and fourth pivot shoes are vertically displaced a predetermined amount to allow pivoting of the window.

According to yet another aspect of the invention the closure member and the preferable window sash may further comprise weather stripping portions extending from the top and bottom thereof.

According to yet another aspect of the invention the cam member having further comprise locking means to lock the pivot pins within cam opening.

According to yet another aspect of the invention the cam member may further comprise recesses upon the surface thereof in alignment with beads upon the perimeter of the opening of the slot of the rectangular body, whereby the recesses and beads when aligned allow sliding movement of the shoe, wherein when not aligned cause the legs to move and cause the locking surfaces to engage the flanges of the guide channel.

According to yet another aspect of the invention the closure assembly may comprise patio doors.

According to still yet another aspect of the invention the handles may further comprise keyed locking means.

According to yet another aspect of the invention a pivot shoe for connection to a pivotable and slidable closure member (preferably a window sash) is provided for movement in a guiding channel having outwardly extending flanges, the pivot shoe comprising a body having a top and bottom and two ends (preferably formed from thermoplastic materials), said body having disposed at one end thereof an opening being generally cylindrical in shape, the body having disposed upon the perimeter of the opening at least one bead (preferably laterally opposed) extending towards the center of the opening, the opening having a cam member disposed therein engagable with the closure member and having disposed upon its perimeter at least one recess (preferably laterally opposed) compatibly shaped with and for engagement with the at least one bead of the opening, the cam for engaging clamping means disposed with said pivot shoe for clamping against the outwardly extending flanges of the guide channel when at least one recess of the cam moves from a position wherein it is aligned with the at least one bead of the body disposed proximate said opening, to a position wherein it is not aligned with said bead.

According to yet another aspect of the invention the pivot shoe may further comprise roller means to improve the sliding movement thereof in the guiding channel.

According to yet another aspect of the invention each pivot shoe may further comprise fastening means to fasten more than one pivot shoes together. Preferably each body having an opening on the top thereof remote the cam for accepting a screw fastener. Preferably the fastening means being adjustable.

According to yet another aspect of the invention the roller means may further comprise at least one roller having a central axis and having mounting pins extending from the ends thereof preferably for insertion within an opening within said body proximate the bottom thereof, the opening for said mounting pins being tapered from bottom to top wherein the narrowed portion is of less width than the diameter of the mounting pins, the narrow taper having an arcuate portion above it to retain the mounting pins in position in use.

According to yet another aspect of the invention the pivot shoe may further comprise clamping means extending wherein the clamping means are two legs of the body proximate the opening created by a slot extending from proximate the top to proximate the bottom of the body and substantially bisecting the openings, each leg by movable into clamping engagement with the outwardly extending flanges of the guiding channel when the cam is pivoted.

According to a further aspect of the invention the assembly may comprise a carrier wherein the locking means of the pivot shoe further comprises braking surfaces affixed to the pivot shoe to engage the track portions of the closure assembly. In a preferred embodiment the braking surfaces further comprises preferably metal inserts having pebbled surfaces.

In yet another aspect of the invention there is provided for a closure assembly a pivot shoe having an opening therewith moveable in track portions of the closure assembly, the pivot shoe having camming means disposed in the opening, locking means disposed with the pivot shoe for engagement with track portion of the closure assembly, the locking means having braking surfaces therewith to engage the track portions of the closure assembly. In a preferred embodiment the braking surfaces further comprises inserts affixed to the pivot shoe. Preferably the inserts have a pebbled preferably metallic surface.

In another embodiment the pivot shoe includes a recess disposed proximate the side thereof within which the insert including the braking surfaces is disposed. Preferably the recess includes means to orient the braking surface to the surface of the track it will engage when the locking means of the brake shoe is operated to engage the track. In a preferred embodiment the brake surfaces are disposed upon the surface of a braking element disposed in the recess of the brake shoe. Preferably the braking element is substantially L shaped in cross section and includes a first and second portion. Preferably the first portion includes the brake surfaces, and the second portion includes engaging portions to engage the recess of the shoe, the recess having disposed therein means (preferably a slot) to allow the braking element to float in the recess and remain oriented substantially parallel to the track portion to be engaged when the locking means of the shoe are operated to engage the track.

According to one aspect of the invention there is provided for use in a track having at least one engaging portion therewith, the track being part of a closure assembly, a pivot shoe for movement in the track of the closure assembly, the pivot shoe comprising a carrier portion for movement within the track, preferably the carrier portion having disposed proximate the bottom thereof rolling means for assisting the motion of the shoe within the track of the closure assembly in use, the shoe having disposed therewith clamping means to clamp in use at least one engaging portion of the track of the closure assembly, the clamping means being in engagement with operating means moveable from a position wherein the clamping means engage the at least one engaging portion of the track wherein the closure member of the closure assembly is locked or secured in position, to a position wherein the clamping means disengages the at least one engaging portion of the track wherein the closure member of the closure assembly is free to move in the track.

In a preferred embodiment the shoe includes an opening within which a handle portion moves, the handle portion having a cam portion disposed at one end and a lever portion disposed at the other end, the opening having disposed therewith the cam portion of the handle portion and a first clamping portion, the carrier having a second clamping surface disposed therewith (preferably the second clamping surface including a brake pad having a preferably pebbled braking surface for engagement with the at least one portion of the track, the first clamping portion being moveable with respect to the second clamping surface of the carrier portion by the operation of the handle portion which engages with the first clamping portion proximate the cam portion thereof to clamp the at least one portion of the track against the at least a second surface, the handle portion including the lever portion engaging with the a sash retainer disposed with the closure member when the the shoe is disengaged from the track, wherein the operating means is moveable from a position wherein the first clamping portion and the second clamping portion engage the at least one portion of the track of the closure assembly whereat the operating means is moved to its locking position, the cam means thereof having moved the first clamping portion to engage with the at least one portion of the track of the closure assembly clamped between the first clamping portion and the second clamping surface, whereat the sash retainer of the closure member is disengaged from the lever portion of the handle portion whereat the closure member is free to move away from the track of the closure assembly to a position wherein the handle portion moves the first clamping portion away from the at least detent of the track and the second clamping surface by the motion of the cam portion of the handle portion, whereat the lever portion of the handle portion is engaged with the sash retainer of the closure member wherein the closure member is in engagement with the carrier portion and can slide in the track of the closure member of the closure assembly upon the pivot shoe.

In essence the shoe described in the previous paragraph although different in structure, is similar in operation to the shoe illustrated in FIG. 6C and 6D of the U.S. Pat. No. 4,888,915 wherein when the closure member is engage by the detent of the locking member it will move only within the track of the closure assembly. When the locking member is released from the detent portion of the closure member and the closure member is free to move away from the track then the portions engaging the track lock against the side portions of the track. Of course there is no reference to clamping portions clamping a portion of the track therebetween.

In a preferred embodiment a track of a closure assembly is provided the track having at least a first engaging portion disposed therewith preferably being a flange, the at least a first engaging portion riding between clamping portion of the shoe, the shoe including an operating portion having a cam portion at one end and a lever portion at the other, the operating portion being moveable from a position wherein the lever portion engages the sash retainer of the closure assembly (similar to that which is described in relations to FIGS. 6C anc 6D of my patent) to a position wherein the sash retainer of the closure assembly is disengaged but the clamping surfaces clamp the at least at first engaging portion of the track, preferably at least a first flange, to prevent the motion of the shoe with respect to the track.

In one preferred embodiment the shoe of the instant invention is inter-connected with a second shoe by interconnecting means, the second shoe including portions to allow the movement of the window away from the track of the closure assembly, wherein when the closure member is moved away from the track assembly such motion will cause clamping surfaces disposed with the second shoe to clamp the at least at first engaging portion of the track therebetween and securing the position of the shoe in the track of the closure assembly while the closure member is moving away from the closure assembly.

According to yet another aspect of the invention there is provided for use in a closure assembly having a track disposed therewith within which a closure member is moveable, a pivot shoe comprising a first and second clamping portion containing at least a first engaging portion of the track therebetween in use and for engaging the at least a first engaging portion therebetween in the lock position and disengaging the engaging portion therebetween yet maintaining the position of the engaging portion therebetween in use, the shoe including operating means for providing the motion of at least one of the clamping means with respect to the other clamping means and the at least at first engaging portion of the track, the operating means being operable from a first position wherein the clamping means clamp the at least a first engaging portion of the track to a second position wherein the clamping means disengages the at least a first engaging portion of the track of the closure assembly in use. Preferably the at least a first engaging portion of the track may comprise flanges preferably extending substantially laterally away from the sides of the track towards one another. In a preferred embodiment the clamping surfaces retain the laterally extending flanges therebetween and move thereupon with the sliding of the closure member within the track of closure assembly. In another embodiment the clamping portions clamp the laterally extending flanges top and bottom thereof to capture the flanges therebetween in the lock position and to retain the flange therebetween in the disengaged position. In yet another embodiment at least one of the clamping portions has disposed therewith a brake pad, preferably metal, which engages the bottom of the laterally extending flanges.

According to one aspect of the invention there is provided for use with a closure assembly a shoe, the closure assembly having a closure member and a peripheral frame having disposed therewith a track or rail within which the closure member is moveably secured in use from an initial position wherein the closure member extends substantially parallel to the frame to a position wherein the closure member is disposed at an angle to the frame, the track or rail having at least a first engaging portion and at least a second engaging portion, the shoe comprising at least a third detent and at least a fourth detent to engage the at least a first engaging portion and at least a second engaging portion of the track or rail, the at least a third detent for engagement with with the at least a first engaging portion of the track or rail when the closure member is disposed in the initial position to secure the shoe and the closure assembly thereat, the at least a fourth detent for engagement with the at least a second engaging portion of the track or rail when the closure member is moved past a predetermined angle towards a fully open position, the track or rail with the at least a first engaging portion and at least a second engaging portion being removably engagable with the at least a third detent and the at least a fourth detent of the shoe by the operation of first and second operating means respectively, the first and second operating means disposed with the shoe and moveable from a position wherein the detent portions of the shoe engage the engaging portions of the track or rail to a position wherein the detent portions disengage the track or rail portions, whereby when the closure member is in the first position the first operating means is operated to engage the at least a third detent of the shoe with the at least a first engaging portion of the track or rail thus securing the shoe and the closure member in the track or rail, whereat when the first operating means is operated to disengage the at least a third detent of the shoe with the at least a first engaging portion of the track or rail the closure member is free to move, whereat when the closure member is moved past the predetermined angle towards a fully open position the second operating means of the shoe is operated at the predetermined angle to engage the at least a fourth detent of the shoe with the at least a second engaging portion of the track thus securing the shoe and the closure member in the track or rail, whereat when closure member is moved towards the initial position and past the predetermined angle, the at least a fourth detent of the shoe disengages the at least a second engaging portion of the track or rail, whereat the closure member is moved to the initial position to be secured thereat when the first operating means is operated to engage the at least a third detent of the shoe with the at least a first engaging portion of the track or rail.

According to yet another aspect of the invention the shoe may further comprise a pivot shoe carried in the track or rail of the closure assembly wherein the at least a first engaging portion and the at least a second engaging portion are surfaces of the track or rail and wherein the at least a third detent and the at least a fourth detent of the shoe are portions of the shoe each portion having at least a surface disposed proximate the surfaces of the track or rail. In a preferred embodiment the first and second operating means of the shoe are first and second cam members which engage the portions of the shoe having at least a surface disposed proximate the surfaces of the track or rail. Preferably the first cam member of the shoe has a handle engaged therewith, the handle to move the first cam member to engage the portions of the shoe having the at least a surface disposed proximate the surfaces of the track or rail and to move the at least a surface into locking engagement therewith. Preferably the second cam member of the shoe has a pivot means (preferably an opening for receiving the pin of the closure member) disposed therewith for engagement with pivot means (preferably a pin of the closure member engaged therewith), the pivot means of the closure assembly and the shoe to move the second cam member to engage the portions of the shoe having the at least a surface disposed proximate the surfaces of the track or rail and to move the at least a surface into locking engagement therewith.

According to yet another aspect of the invention the pivot shoe may further comprise first and second operating means comprising one integral means operable in two modes to effect the engagement of the shoe with the track or rail of the closure assembly.

According to yet another aspect of the invention the pivot shoe may further comprise detent portions which engage first and third engaging portions of the track or channel which are first and second surfaces. In a preferred embodiment the third engaging portions are flanges which extend substantially laterally toward one anther disposed proximate the top of a generally U shaped channel. Preferably the pivot shoe further comprises second and fourth detents which engage the flanges and the surfaces.

According the yet another aspect of the invention the pivot shoe may further comprise second and fourth detents which are upper and lower detents, one disposed above the other and having opposite facing surfaces, the surfaces being moveable with respect to one another and which clamp down or alternatively upward against the first and third engaging portions of the track which are preferably flanges.

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 1:
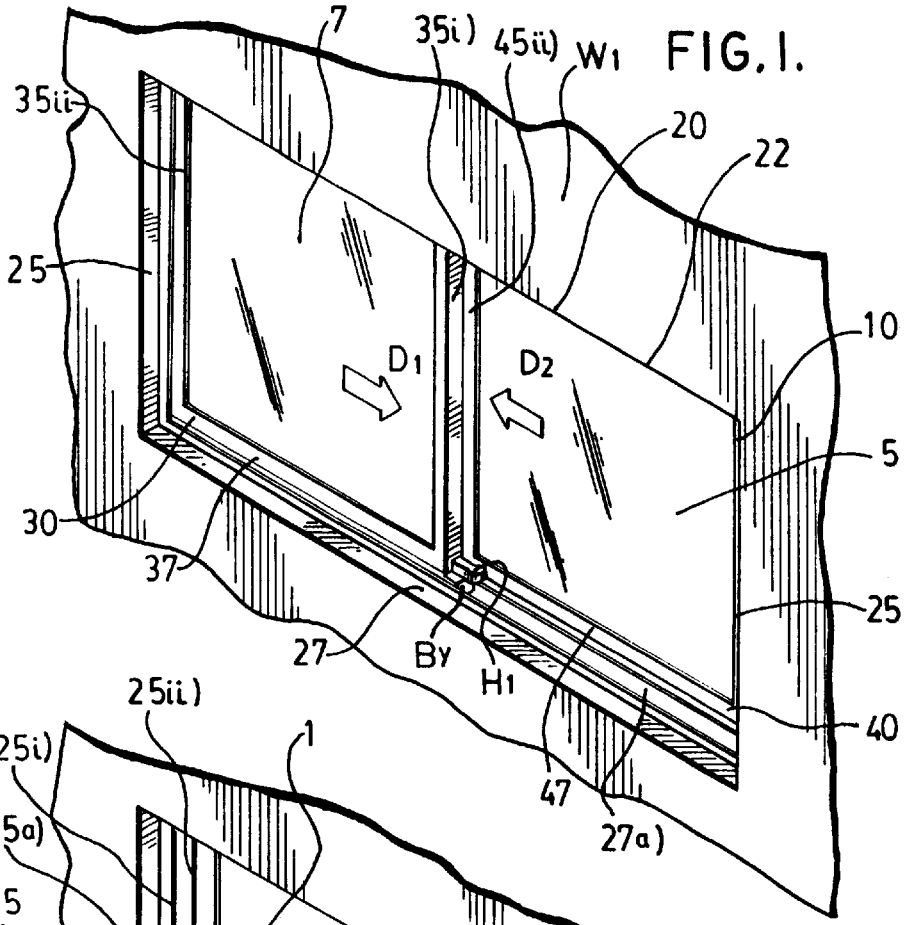
FIG. 1 is a perspective view of a tilt sliding window assembly illustrated in a preferred embodiment of the invention.
Figure 7A:
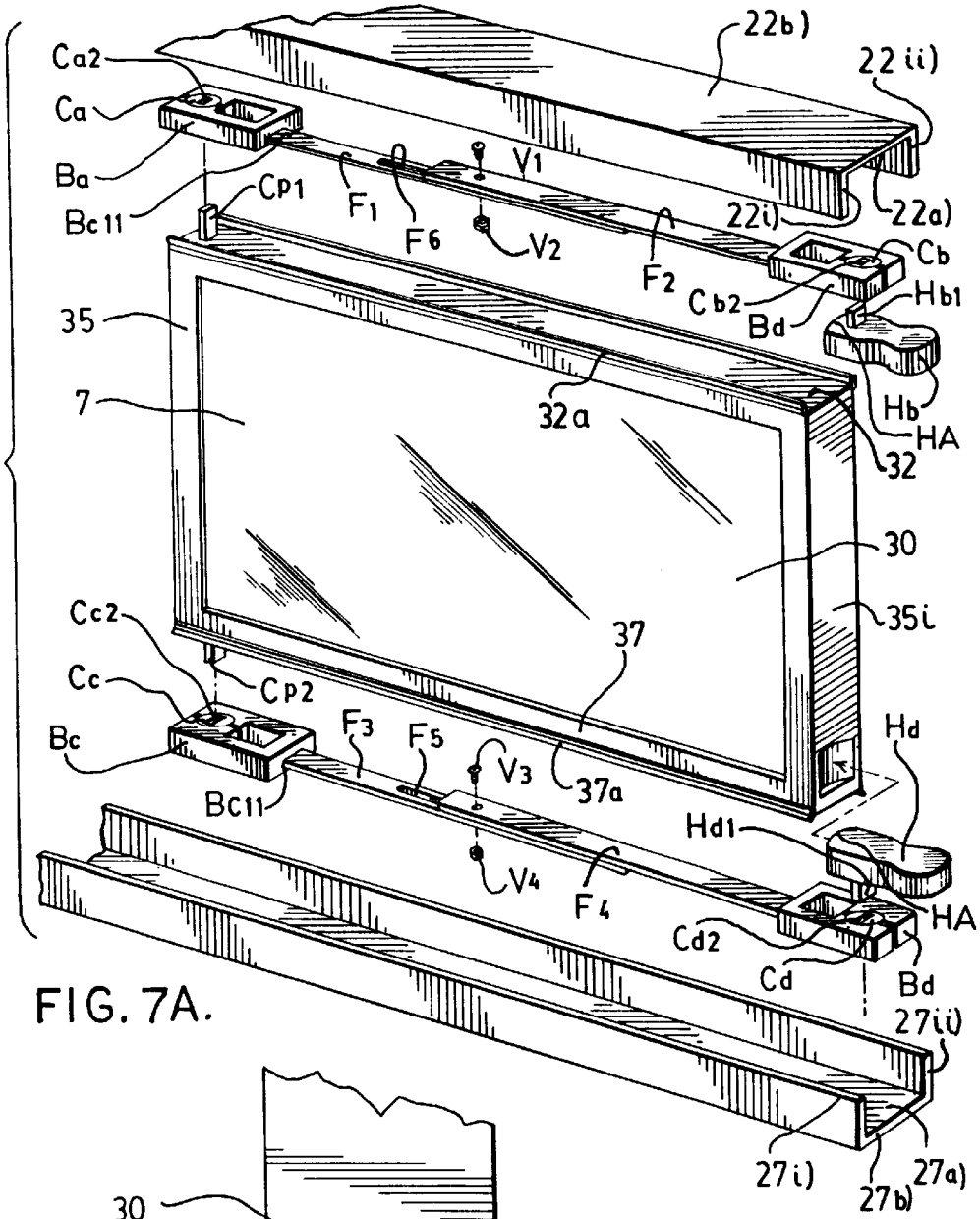
FIG. 7*a* is a exploded perspective view of the sash 30 of FIG. 1 illustrating the operating components thereof in a preferred embodiment of the invention.

Referring now to FIG. 1, there is illustrated a wall W1 having an opening therein within which a window assembly 10 is contained. The window assembly 10 is made up of a peripheral frame 20 having a header portion 22 and a sill portion 27 interconnected by vertical stiles 25. Disposed upon the header section 22 and the footer section 27 are track or channel portions 27*a* and 22*a* not shown. Window sash elements 30 and 40 are slidably received within the track portions 27*a* and 22*a* respectively. The sash elements 30 and 40 slide in directions D1 and D2 respectively from open to closed positions as is known in the art. However, at the corners of each window assembly, as best illustrated in relation to FIG. 7*a* are disposed carrier mechanisms, such as By found in FIG. 1 which offer unique features which allow the window to both slide in the directions D1 and D2 and to pivot in a direction laterally away from the window frame 20.

The sash element 30 is made up of horizontally extending members 37 and 27 and vertically extending members 35*i* and 35*ii*. Window sash element 40 is comprised of horizontally extending elements 47 and 42 and vertically extending elements 45*i* and 45*ii*.

The block or carrier mechanism By has a handle disposed thereupon $H_1$ which allow the window to be locked in position in its sliding mode the details which will be described hereinafter.

Figure 2:
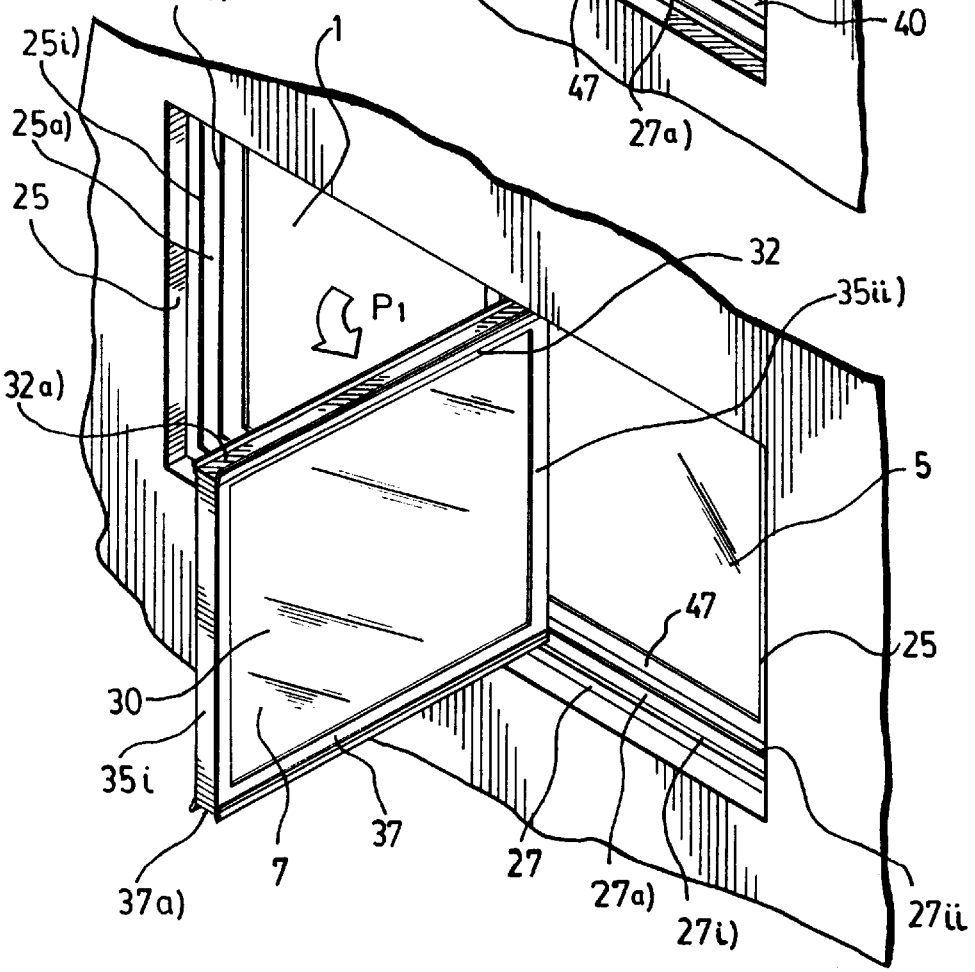
FIG. 2 is a similar view to that of FIG. 1, illustrating the movement of the sash of the window assembly in a preferred embodiment of the invention.

Referring now to FIG. 2, there is illustrated the identical window assembly of FIG. 1 with all of the components thereof, wherein the window sash 30 has moved from its position proximate the frame member 25*a* to a position wherein the opening 1, normally covered by a screen allows the passage of air from the outside environment. The handle H1 has been rotated as illustrated in relation to FIG. 6F and 6G to allow for the pivoting of a sash 30 in a direction P1 to allow for the cleaning of the window pane 7 on both side thereof. A window normally has a tendency to sag when held in the position illustrated in FIG. 2, however, because of a unique bracing system, as illustrated in FIG. 7*a* the window remains firmly locked and supported in the position illustrated in FIG. 2. The details of such mechanism will be described hereinafter.

Figure 3:
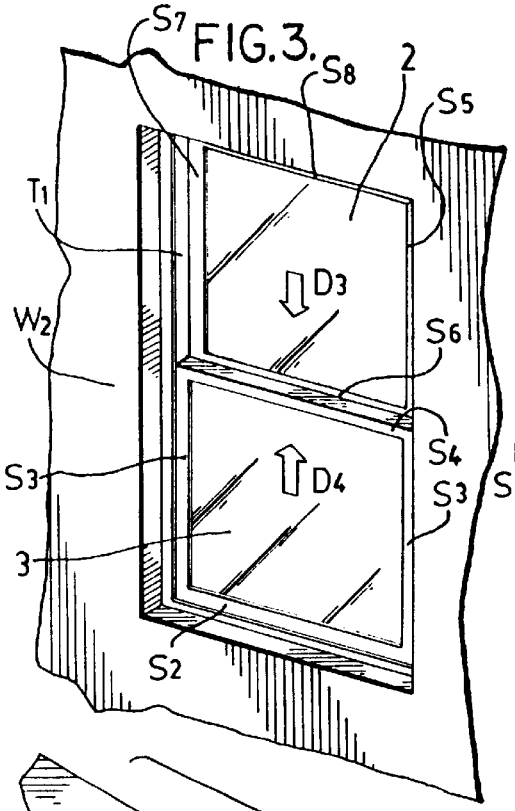
FIG. 3 is a perspective view of a double hung window assembly illustrated in an alternative embodiment of the invention.
Figure 4:
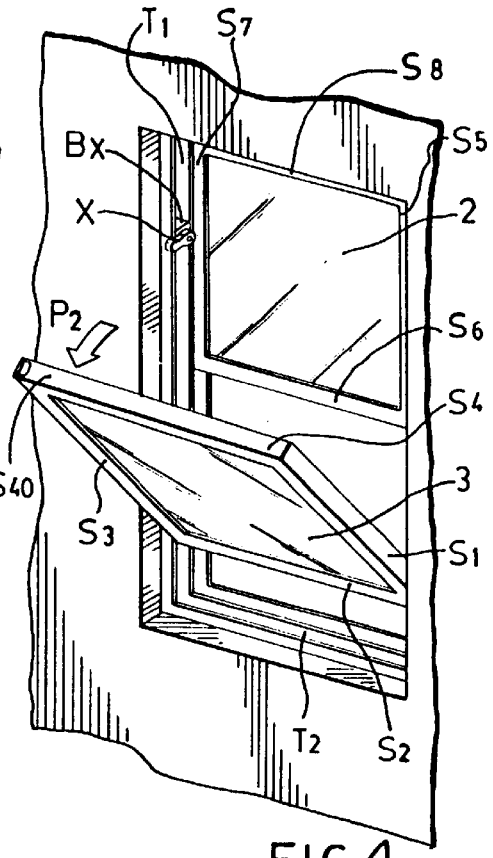
FIG. 4 is a view similar to that of FIG. 3, illustrating the movement of the sash portion of the window assembly in an alternative embodiment of the invention.

Referring now to FIGS. 3 and 4, there is illustrated a double hung tilting window assembly, wherein sash elements 2 and 3 are supported on a track T1 extending in a generally vertical direction for sliding of the sashes 2 and 3 therein. For purposes of illustration, all track elements extending vertically are entitled T1. The window sashes 2 and 3 can move in directions D4 and D3, within a multiplicity T1, two each for each window, extending substantially vertically. Each stile 2 and 3 are composed of sections S1, S2, S3, S4, S5, S6, S7, and S8 respectively as is known in the art. However, a block Bx as best illustrated in relation to FIG. 6F and 6G is provided to allow the pivoting of the window sash 3 in a direction P2 allow the cleaning thereof while ensuring the firm support of the window and the placement of the block Bx within guide channel S40 disposed within member S4. Further illustrated in FIG. 4 are track portions T2 disposed in a general horizontal direction as is known in the art. The block Bx may be conveniently attached to the sash balance of a double hung window in order to ensure the operation of the mechanism. As illustrated in FIG. 7*a* the block or carrier Bx would be connected to the pivoting member or carrier at the end of the sash 3, wherein horizontally extending portions S2 are disposed. Thus, although the window is pivoted to a position laterally away from its normal sliding position, it is fully supported by a unique structure held within the tracts T1 and locked therein which will be described hereinafter.

Thus, we see that the instant invention has application to sliding windows whether it be the sliding assembly illustrated in FIG. 1 or the sliding assembly illustrated in FIG. 2. The advantages of the invention may still be realized in either embodiment.

Figure 5A:
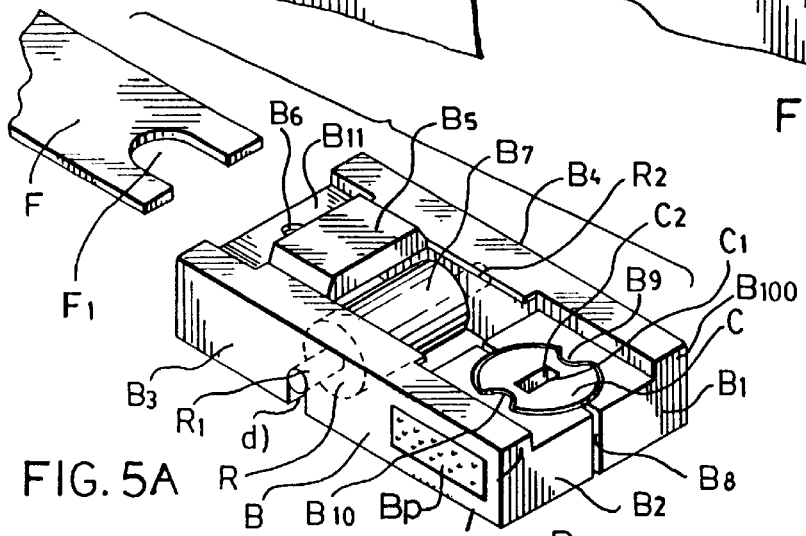
FIG. 5A is a perspective view of a carrier mechanism of a preferred embodiment of the invention illustrating the components thereof.
Figure 6E:
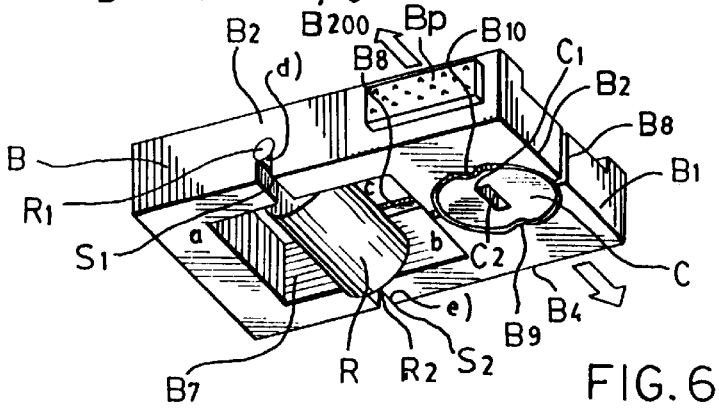
FIG. 6E is a perspective bottom view of the carrier mechanism of FIG. 5A in a preferred embodiment of the invention.
Figure 6A:
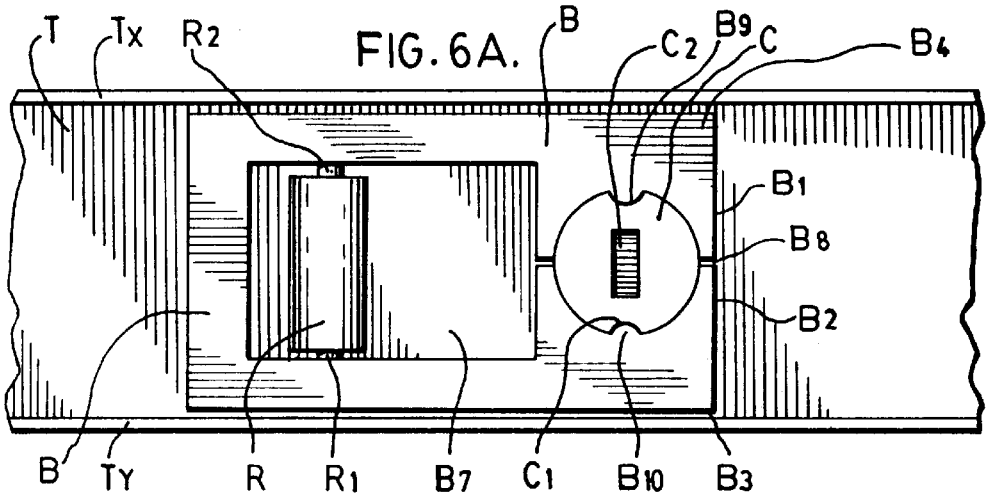
FIGS. 6*a* and 6*b* are schematic views of a fastenerless embodiment of the carrier mechanism of FIG. 6*e,* illustrating the operation of the embodiment.
Figure 6B:
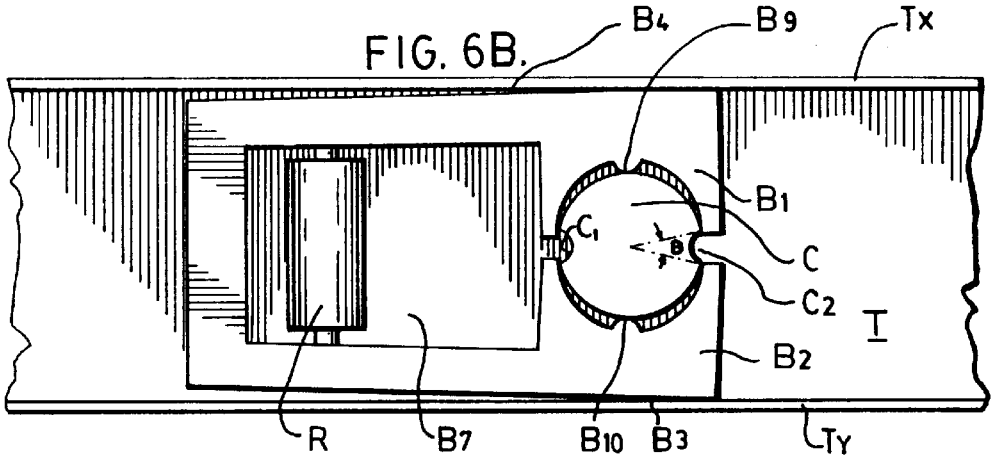
Figure 6C:
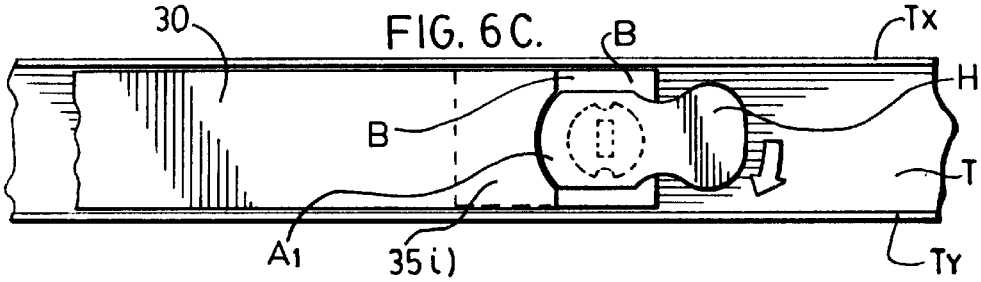
FIGS. 6*c* and 6*d* are schematic top view of the blocks as illustrated in FIG. 6*a* and 6*b* incorporating of another fastenerless embodiment with a handle portion.
Figure 6D:
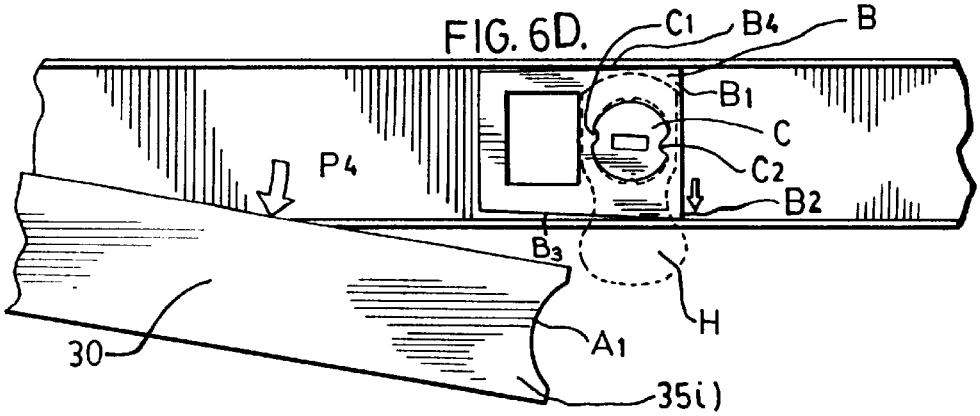
Figure 6F:
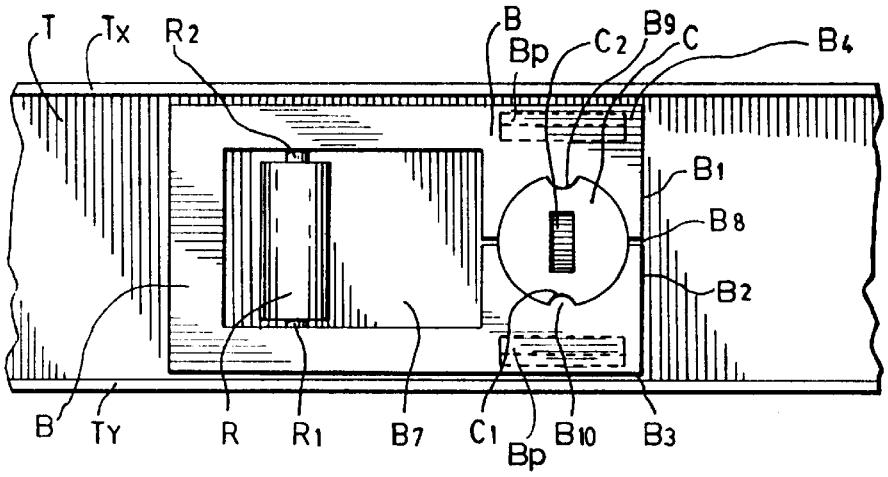
FIG. 6F and 6G are a schematic view of the carrier mechanism of FIG. 6E, illustrating the operation thereof in a preferred embodiment of the invention.
Figure 6G:
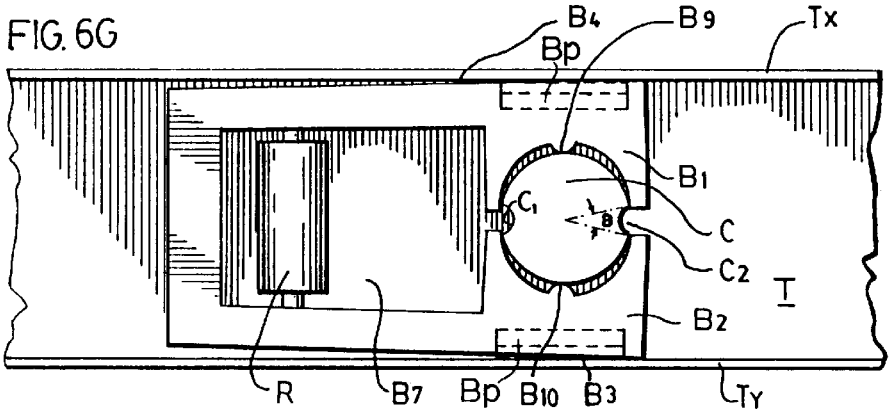

Referring now to FIG. 5A and FIG. 6E, there is illustrated in perspective and bottom perspective views respectively a typical carrier mechanism of the block of a preferred embodiment of the invention. A thermoplastic guide member B is moulded or formed from thermoplastic materials having a top and bottom and two ends, having disposed at one end thereof at the top thereof the fastening element B for interconnecting flat rod F via a notch or recess F1 which will engage with a threaded opening B6 upon a cut out section B11 on the top of the block or carrier B. Of course it is understood that at the other end of the flat rod F, exists another block or carrier mechanism which is clearly illustrated in FIG. 7*a*. The notch F1 may merely be a hole in another embodiment. Located at the other end of the block B extending from top to bottom of a carrier mechanism is a cam portion C having cut out portions C1 disposed on each side thereof facing the track engaging portions B3 and B4 of the block B. Within the cam C is further disposed an opening of generally rectangular shape C2, within which a pin or pivot will extend in order to support the pivoting of the window frame or sash the details of which will be described hereinafter. Located adjacent the recesses C1 of cam C are disposed horizontally extending beads B9 and B10 which extend inwardly towards the center of the cam and extending in a direction of the width of the block B. A slot B8 is located within the block B extending from top to bottom which essentially bisects the opening (not illustrated) within which the cam C rides. The slot B8, thus bisects the front portion of the block B into two legs, B1 and B2 remote the flat bar F. Extending upwardly away from the block B are shoulders B100 and B200 which extend along the length of the block mechanism B and further provide the slot or recess into which the flat bar F will engage. An opening B7 is disposed upon the bottom of the carrier B and the intersection of the opening proximate the top provides for a slot proximate the fastening opening B6 within which the flat bar F is connected. Disposed within the opening is a roller R being supported by extension portions of generally tubular form R1 and R2 which fit within slots S1 and S2 formed upon the bottom of the block B proximate the sidewalls B3 and B4. The opening B7 is formed with peripheral walls A and B and having a top C which is defined as the bottom of a portion B5. The roller is provided for improving the movement of the block within a track or guide channel of a jamb, sill or header.

As is illustrated in relation to FIGS. 6F through 6I, the cam C may contain a pivot pin connected to either a window sash or a handle. The details of the operation of the carrier or block B will now be described in relation to FIGS. 6F through 6I.

Referring now to FIGS. 6F through 6I, there is illustrated in schematic form the operation of a block B or carrier B located within a track T having lateral sidewalls Tx and Ty extending in a direction from top to bottom of the block B. For simplification purposes the main portions of the block B are illustrated, wherein a roller R is supported within openings formed in the carrier mechanism as illustrated in relation to FIGS. 5A and 6E, the openings being slightly smaller at the bottom thereof than the diameter of the pins or tubular extension R1 and R2 in order to ensure a firm fit and in the preferred embodiment the openings having a bevelled shaped proximate the bottom of the carrier B and extending into an arcuate shape approximate the top, thus allowing the pins to be snugly secured within the arcuate opening thus allowing rotation of the roller R1 while providing for a snug fit prevented from being moved by the top bevelled portion of the opening being slightly narrower than the diameter of the pin. It is important that the roller be positioned so as to improve the sliding characteristics of the window and thus it must extend slightly below the carrier bottom. A cam C is located within the opening (not shown) bisected essentially by the slot B8. The cam having recesses within the perimeter thereof at C1 within which complementary beads B9 and B10 extend when the block or carrier is free to slide within the channel or tract T and when the slot C2 containing the pin or pivot (not illustrated) is in a position wherein the slot C2 extends towards the beads B9 and B10. However, as illustrated in FIGS. 6G, when the cam is rotated in the direction wherein the alignment of the recesses C1 and C2 of the cam C are no longer in alignment with the beads B9 and B10, then the leg portions B1 and B2 of the carrier B are forced laterally away from the slot B8 and thus engaging the sidewalls B4 and B3 against the inside surface of the track sidewalls Tx and Ty thus binding the block or carrier B from moving in any direction. The blocks illustrated in FIGS. 6F and 6G are those blocks which allow for the pivoting of the window or sash and allow for the almost immediate locking of the windows or sash when pivoted to its final resting position, whether the pivoting be slight or great. The pivoting of course, must be greater than an angle theta as illustrated in relation to FIG. 6G which is the angle or number of degrees within which the beads B9 will engage with the openings C2. It has been determined in a preferred embodiment that this angle is approximately 9° and thus in this embodiment if the window is pivoted for an angle of greater than 9° it will lock. In the past, windows have pivoted up to 26° without being locked and this has created problems for window hardware manufacturers in that the pivot pins may dislodge from the corresponding cam slots. By minimizing the amount of degrees of freedom for the pivoting of the window, the window is held in locked position for a greater amount of time with greater security. The beads B9 and B10 and the recesses C1 and C2 may be of significant size in order to cause the deflection of the legs B1 and B2 and yet of small enough size that the locking angle or degrees of freedom is kept to a minimum.

Figure 6H:
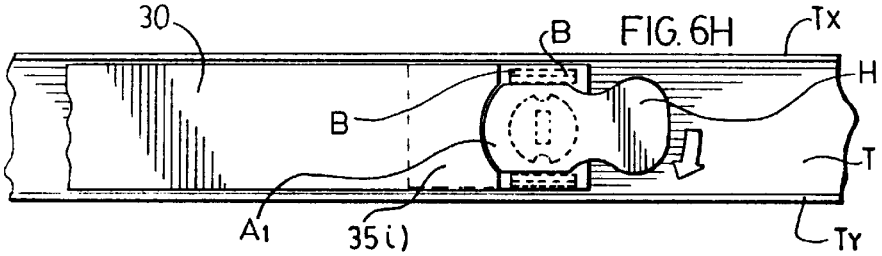
FIG. 6H and 6I are a schematic top view of the blocks as illustrated in FIGS. 6F and 6G incorporating a handle portion in another preferred embodiment of the invention.
Figure 6I:
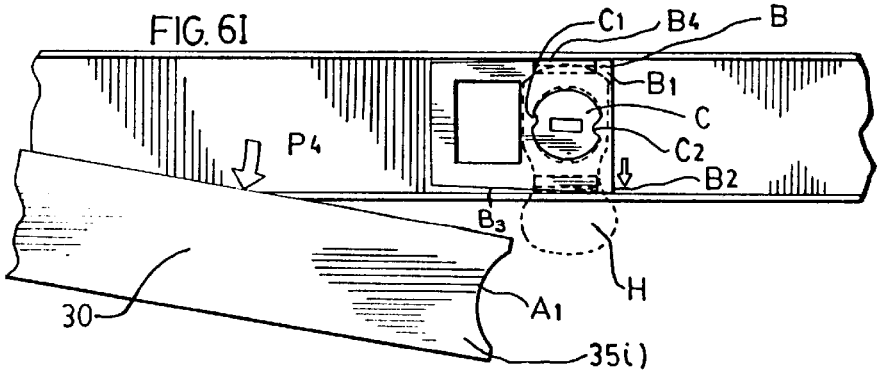
Figure 6J:
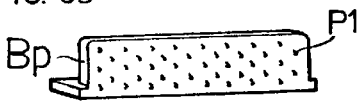
FIG. 6J is a perspective view of a brake pad assembly illustrated in a preferred embodiment of the invention.

Referring now to FIGS. 6H and 6I, a specific advantage of the instant invention is illustrated incorporating the advantages of FIGS. 6F and 6G wherein a block is provided B at the end remote the pivot of the window sash, the bock being interconnected as best illustrated in relation to FIG. 7*a* with the block of the pivoting aspect. However, the block in FIG. 6H and 6I when interconnected with the block of FIG. 6F and 6G provides a tight and supportive bracing structure for the window sash when sliding as illustrated in FIG. 6H, wherein the sash portion 35*i* having an arcuate end portion A1 compatible with the arcuate end portion of the handle Ha prevents the window sash from pivoting but remains in a locked position to allow for the bracing and thus the uniform sliding of the sash within the tract T. However when the handle affixed to the cam via a pin (not shown) connected to slot C2 is rotated in a direction P3, it will as illustrated in relation to FIG. 6G cause the locking of the carrier B in position as the handle is rotated to the position illustrated in FIG. 6I while unlocking the window as the arcuate surfaces A1 and Ha are disjointed. The window sash 30 will then be free to rotate in a direction P4 and will be locked in position upon its pivot as illustrated in relation to FIGS. 6F and 6G while the bracing block is locked in position awaiting for the movement of the sash 30 back into locking engagement with the handle portion H. The bracing portion or block B prevent any movement of the pivot portion upon which the sash 30 is pivoting and thus prevents the dislodging of the pivot pin or the sagging of the window to any substantial extent. This is important so that the portion of the window proximate the arcuate portion A1 will not ride on the weather stripping disposed on the bottom portion of the sash 30. It has been found in the past that with other pivoting windows after a certain amount of time the weather stripping at the end remote the pivot begins to take a lot of abuse and the window begins to ride upon it. By providing a window structure which has a roller which further enhances the movement of the block and by providing a window structure which rides directly upon the blocks and not upon the weather stripping the integrity of the weather stripping is maintained for a greater period of time and the maintenance of the window is thereby reduced. This is clearly observed in relation to FIG. 7*b*.

Figure 7B:
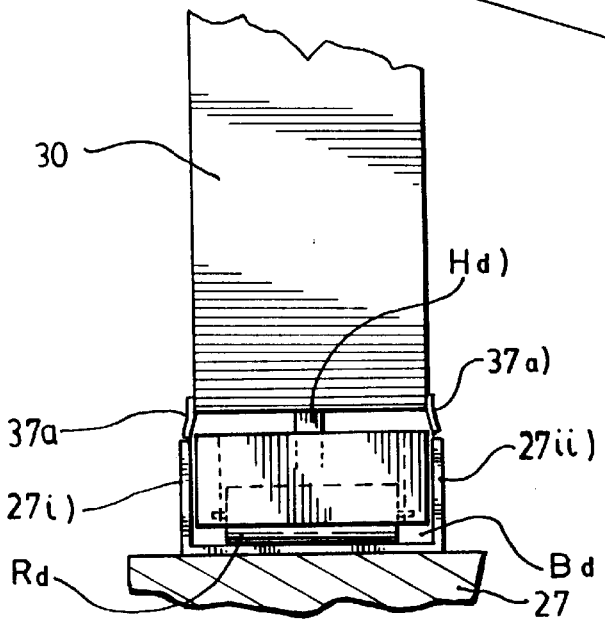
FIG. 7*b* is a close-up cut away end view of the carrier Bd illustrated in a preferred embodiment of the invention.

Referring now to FIG. 7*b*, the aspect described above is clearly illustrated, wherein the portion of the sash 30 being supported upon a pivot pin Hd1 and upon a block Bd riding upon a roller Rd within a channel attached to the sill framing portion 27 wherein members 27*i* and 27*ii* describe a channel within which the block Bd rides. The weather stripping 37*a* is clearly observed as a portion of the bottom of sash member 30 which rides upon the pivot pins Hd1, for example, leaving the weather stripping in a much more reliable state not found within the prior art.

Referring now to FIG. 7*a*, there is illustrated in exploded perspective view the window sash 30 being of generally rectangular form and having horizontally extending sections 32 and 37 and vertically extending portions 35. Disposed upon the top and bottom of sections 32 and 37 respectively are weather stripping portions 32*a* and 37*a* the use of which has already been herein described in relation to FIG. 7*b*. A pivot pin Cp1 and Cp2 are disposed at one end of the window assembly proximate the blocks Ba and Bc respectively. These pivot pins are substantially rectangular in shape and cooperate with the openings Ca2 and Cc2 found within the cams Ca and Cc respectively. Thus the interconnection between the sash and the pivot blocks are through the pivot pins Cp1 and Cp2. At the other end of the sash assembly and interconnected to the locks Ba and Bc are blocks Bb and Bd located at the top and bottom of the window sash respectively. The blocks Bb and Bd have pivot pins Hb1 and Hd1 extending into the cam openings Cb2 and Cd2 of cams Cb and Cd respectively. The handle portions Hb and Hd are connected to the pivot pins Hb1 and Hd1 respectively. The handle portions have arcuate portions Ha disposed remote the portion wherein an operator will grasp the handle.

The arcuate portions Ha extend into the arcuate portions of 35*i* disposed within the vertical sections 35 of the sash 30. Thus the arcuate portion Ha locks the window in position for sliding purposes only and prevents the pivoting thereof when the handle Hb and Hd extend in a line parallel to the extension of the length of the blocks Bb and Bd. Interconnecting the blocks Ba and Bb are two horizontally extending flat bars F1 and F2 interconnected at a fastening screw and nut V1 and V2 extending through an opening within the flat bar F2 and through a slot F6 of the flat bar F1. The slot of course, allows for the adjustability of the hardware when dealing with windows of alternative widths. It has been found that by providing standardized hardware and merely changing the distances which they are spread apart, the instant invention can apply to windows from 12 inches to windows of 48 inches and beyond. When windows of 48 inches and beyond are considered it is advantageous to provide more than two blocks of the essentially same characteristics as those found within FIG. 7*a* with the advantage that the additional blocks assist in the sliding of the window and in the bracing of the window, the blocks in the central portions being of essential neutral ability not incorporating pins in one embodiment, thereby serving only as a sliding aid. For purposes of illustration, the rollers have been left out of the description in relation to FIG. 7*a* as they were described clearly in relation to FIGS. 6F through 6I. The purpose of FIG. 7*a* is to illustrate the interconnection of the blocks.

Blocks Bc and Bd are interconnected in similar manner to the blocks Ba and Bb. Thus, a flat bar F3 and F4 are provided with a pin and nut arrangement V3 and V4 extending through an opening through the top of flat bar F4 and extending through a slot F5 within the flat bar F3 which again gives the adjustability of the distances between the blocks. Portions Ba11, Bb11, Bc11, and Bd11 (not shown) are provided within the blocks to allow for the interconnection of the flat bars F1, F2, F3, and F4 respectively which are fastened by a pin or alternative fasteners. It is important that the fastening be secure and the flat bar strong. Of course as is well known in the art, channels located upon the header and sill portions 22 and 27 are provided having a top and bottom 22*b* and 27*b* respectively and vertically extending sidewalls 22*i*, 22*ii*, 27*i* and 27*ii* respectively, having a surface 22*a* and 27*a* upon which the blocks will move upon the rollers.

Figure 8:
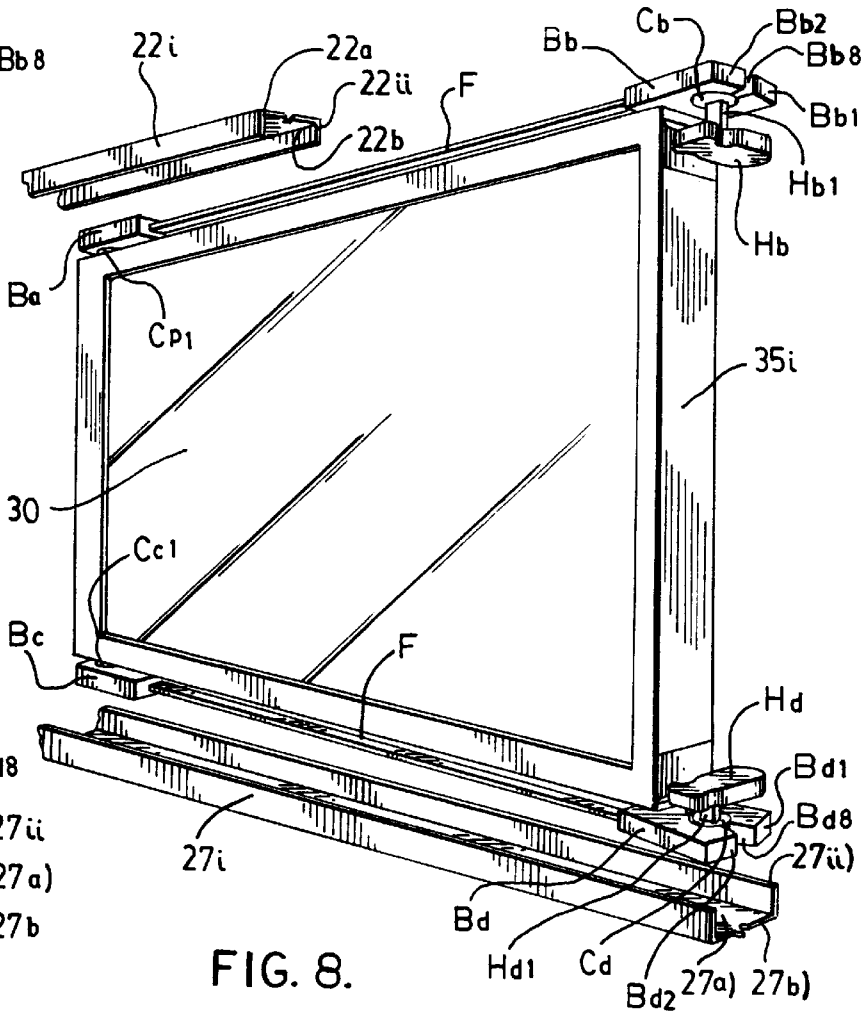
FIGS. 7*c*, 8 and 9 are partly exploded perspective views of the sash 30 of FIG. 7*a* illustrated in a sequence of events for sliding and tilting of the window in a preferred embodiment of the invention.
Figure 7C:
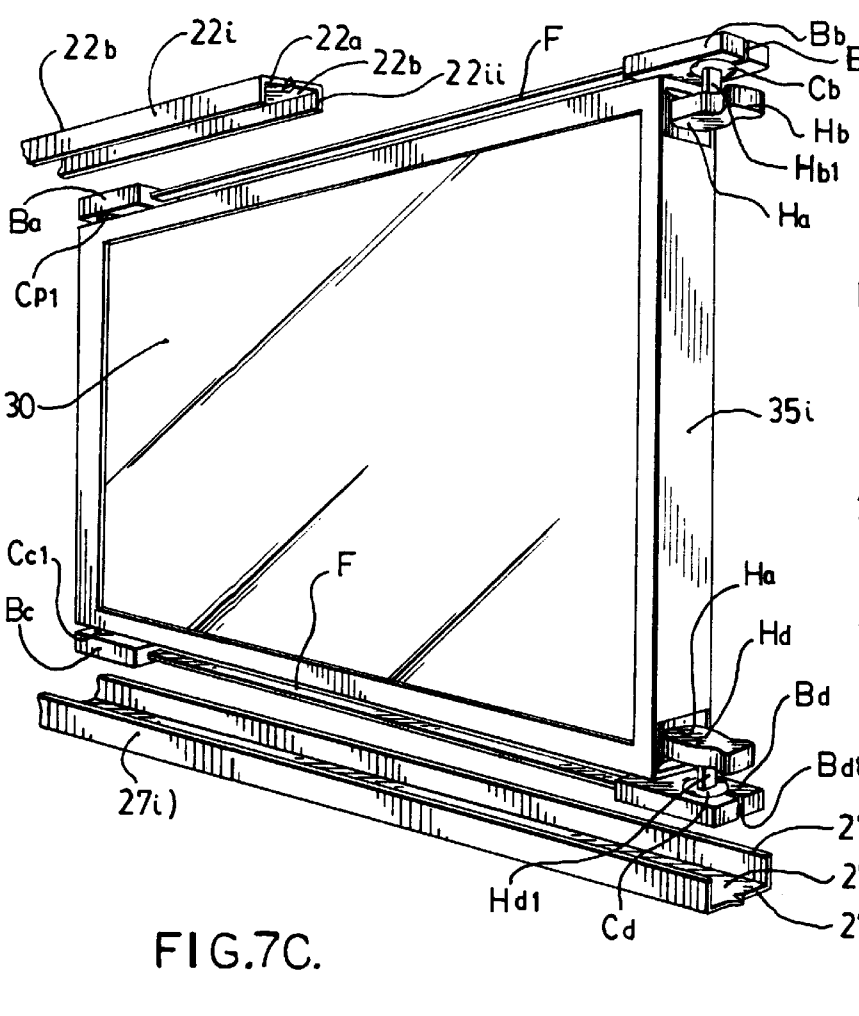
Figure 9:
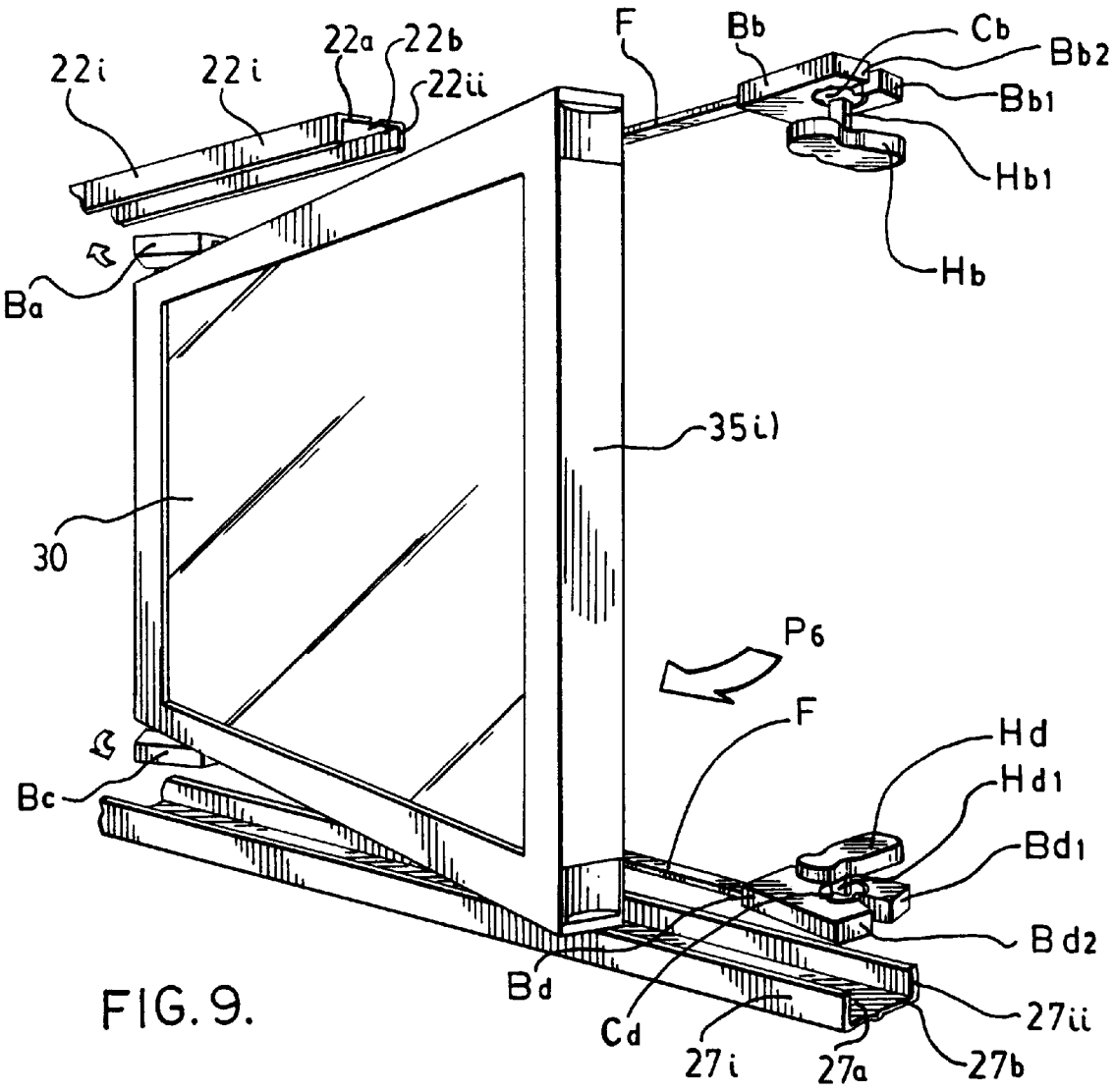

Referring now to FIGS. 7*c*, 8 and 9 there is illustrated a sequence of events which allows for the sliding of the window within the channels as illustrated in relation to FIG. 7*a* upon blocks Ba, Bb, Bc, and Bd respectively interconnected as illustrated in FIG. 7*a*. Thus, when the handle Hb and Hd are in a position such that the arcuate portions Ha are securely locked within the recess or arcuate portion 35*a* of the vertically extending section 35 of window sash 30, the window sash 30 is only able to slide along the channels 22*i* and 27*i* while the blocks and the pivot pins remain in position such that the openings within which the pivot pins are retained (which are emphasized for the purposes of illustration in relation to FIGS. 7*c*, 8, and 9) and allow for the movement of the window sash in slidable fashion only. However, as illustrated in FIG. 8, when the handles Hb and Hd are rotated in a direction such that the handles extend in a direction normal to the extension of the window, the blocks Bb and Bd will lock against the sidewalls 22*i*, 22*ii*, 27*i* and 27*ii* respectively preventing the movement of the blocks Ba and Bc in any slidable direction while the window sash 30 is free to pivot as illustrated in relation to FIG. 9, thus pivoting in a direction B6 and has been clearly described in relation to FIGS. 6F through 6I. When the window sash 30 begins to pivot the sidewalls of the blocks Ba and Bc will engage the sidewalls 27*i*, 27*ii*, 22*i* and 22*ii* respectively by the motion of the cam Ca, and Cc, in the direction such that the beaded portions of the carrier will cause the legs Ba1, Ba2, and Bc1, Bc2 to lock against the side rail portions preventing the movement of the window sash in a sliding direction and further as described above while ensuring the location of the blocks Bb and Bd when the window is pivoted back to its sliding position. By the blocks Ba and Bb being interconnected and the blocks Bc and Bd being interconnected, by the flat bar members, a firm bracing system has been provided which prevents the movement of the end of the window wherein the pivoting occurs proximate blocks Ba and Bc and prevents the pins Cp1, Cp1 from dislodging from the cam openings and further eliminates the need to anchor them in one embodiment of the invention. For safety sake to further enhance the stability of the hardware the fastener to the pin need not be eliminated but may be incorporated. However, the window will not sag, nor will the ends at which the windows pivot proximate the blocks Ba and Bc have a tendency to go out of parallel with the window frame. Nor will the weather stripping take a necessary load from the window as the window will be securely held in an upright position upon the pivots braced with the forward blocks or carriers Bb and Bd.

Thus the invention has provided a window assembly in a preferred embodiment which slides and pivots incorporating block mechanisms or carriers which allow for the sliding in cooperative fashion and pivoting in cooperative fashion, some of the pivots incorporating handle portions which lock the window in its sliding position and which unlock the window from its aligning position but simultaneously lock the pivoting block in position as a result by locking the handle block in position. Rollers have been provided to more uniformly advance the sliding of the window sash within the tracks or channels.

It is of course understood that the alternative embodiments of the invention would incorporate other closure members such as patio doors which would operate in identical manner to that described in relation to the figures of the vertical tilt slider illustrated in a preferred embodiment of the invention. However, the hardware provided would be more substantial in material but incorporate all of the design features illustrated in the drawings. It is intended that any tiltable and sliding closure device be construed as part of the invention and the invention is thus not limited to windows alone, but has broader application than described above.

Figure 10:
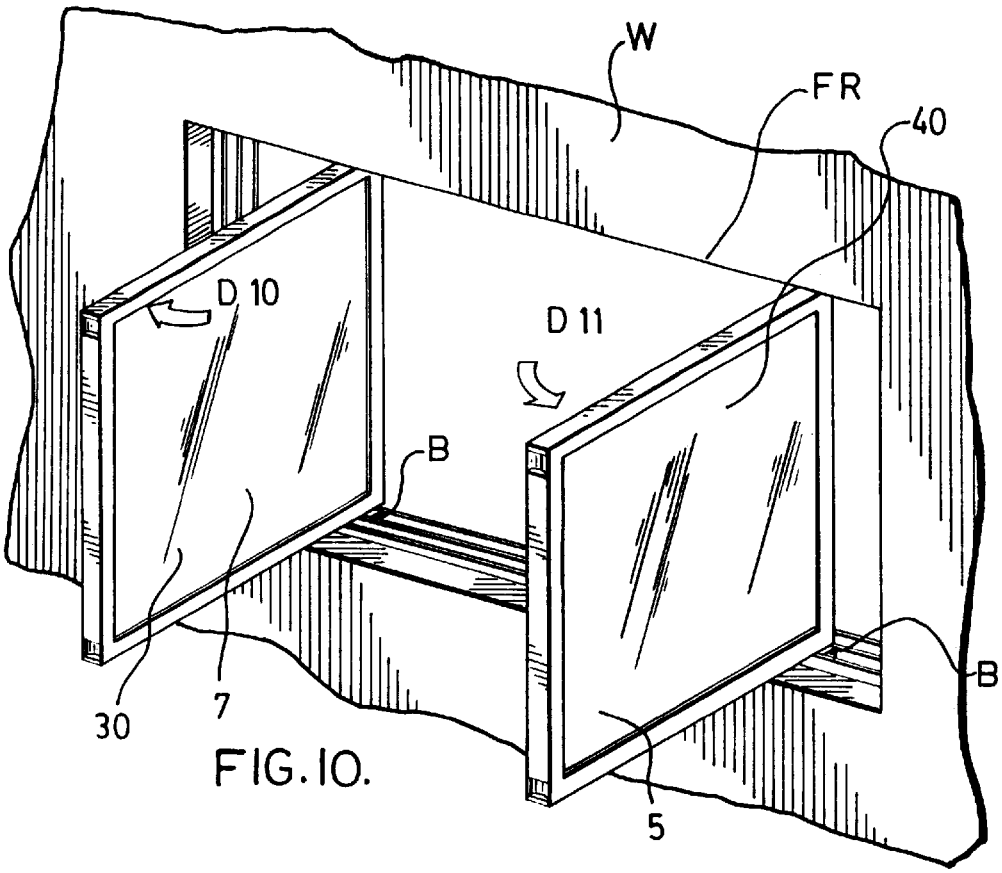
FIG. 10 is a perspective view of the window assembly of FIG. 1 as shown in a fully opened position in a preferred embodiment of the invention.

Referring now to FIG. 10, there is illustrated the vertical tilt sliding window assembly of FIG. 1, illustrating the sash elements 30 and 40 being slidable within the tracks disposed within a frame Fr and being pivotable upon blocks B in direction D10 and D11 respectively, wherein the window glass 7 and 5 may be cleaned on both sides and pivoted back for sliding movement within the tracks upon frame Fr. The pivoting movement illustrated in relation to directions D10, and D11 simulate that of French doors and of course have broad application in the assembly of patio doors which normally only slide within a track assembly, by improving patio doors embodied in the invention described above using the hardware described above, a firm solid pivoting assembly is provided which allow for the appearance of French doors in many designs which may enhance the beauty of patio door and vertically disposed tilt sliding windows.

Figure 11:
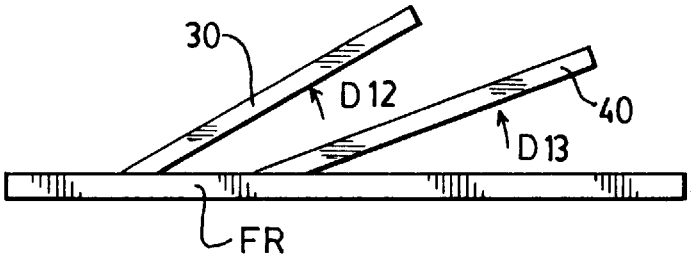
FIGS. 11, 12 and 13 are top schematic views of the layout of alternatively pivoting window sashes embodied within the window assembly of FIG. 1 in alternative embodiments of the invention.
Figure 12:
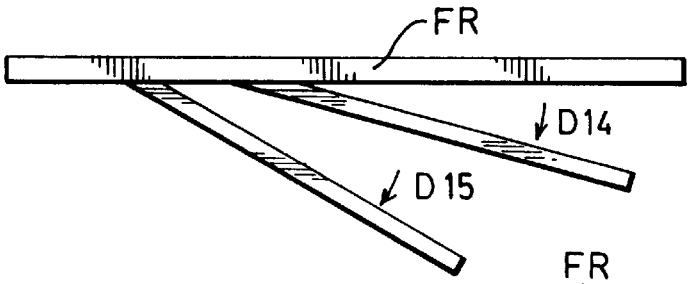
Figure 13:
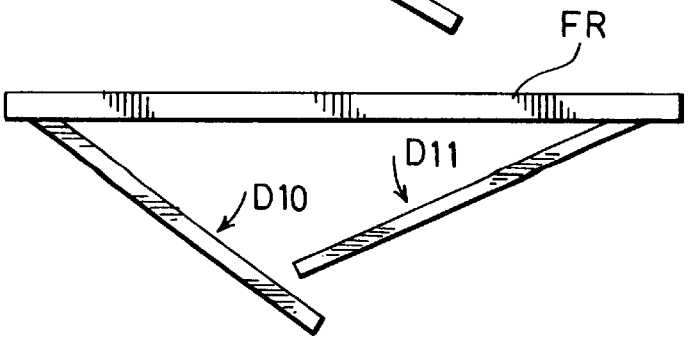
Figure 14:
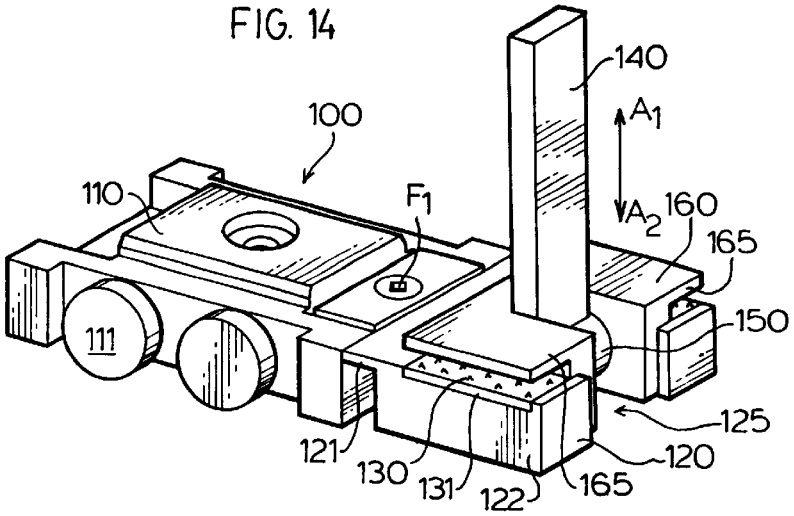
FIG. 14 is a perspective view of a brake shoe incorporating clamping portions illustrated in a preferred embodiment of the invention.

FIGS. 11, 12, and 13 describe only three alternative pivoting directions of the window sashes 30 and 40, that described in FIG. 13 being identical to that in FIG. 10. Thus the windows may be swung out in directions D12 and D13 or may be swung inward in directions D14, and D15. The design of the invention is to allow the greater flexibility for window manufacturers and to allow for a standardization of inventories. It is not important as to which extrusions are used for the framing sections. Further, it is not important as to what guide channels are provided. The invention may be applied to any window design and to any sash design providing the features described herein are incorporated into the design and that the shoe or carrier is dimensioned so as to ride within the guides or channels provided within each individual window design. The flat bars may come in one piece or in sections to allow for variation in the size of windows and it is at the present, determined that three sizes of hardware may be supplied to provide for all window sizes presently in the marketplace. However, this is not stated as a limiting aspect of the invention as any new development or unique window design may be incorporated and embodied with the unique hardware of the present invention.

In an embodiment as illustrated in FIG. 5A, 6E, and 6F–M the clamping surfaces B3, B4 of FIG. 6G include a braking element Bp which is generally L shaped in cross section and includes a portion Bp2 which includes the braking surfaces including pebbles P1 and a portion Bp1 which engages the recess of the shoe By1 and By2. The braking surface includes metal inserts having a generally rectangular shape and having a pebbled surface. On the face of the clamping surfaces B3, and B4 there is a cut out or opening in which these inserts may be fastened. These inserts behave as brake pads and improve the performance of the entire system by ensuring a positive braking action much the same as brake shoes of an automobile.

Figure 6K:
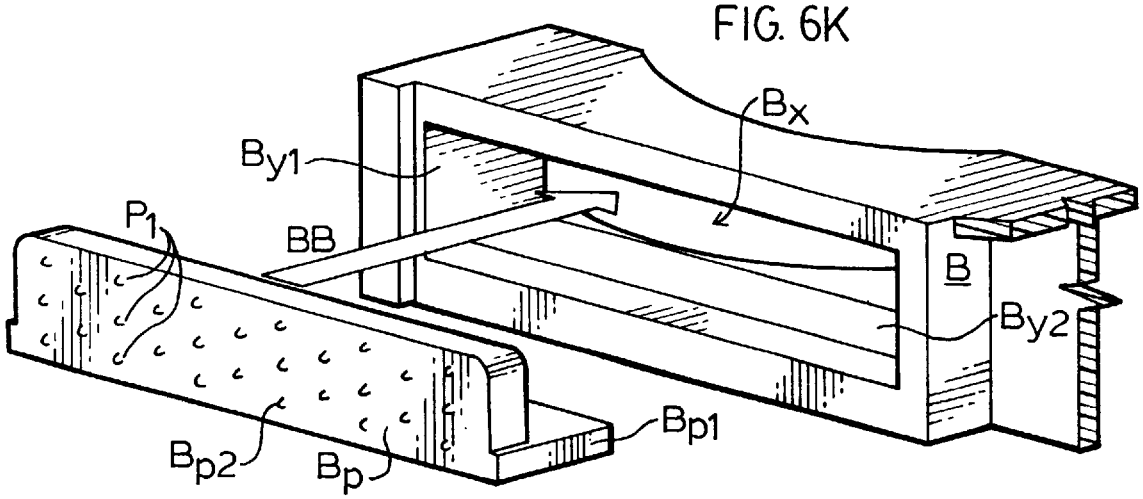
FIGS. 6K,L,and M are closeup views of the brake assembly of FIG. 5A.
Figure 6L:
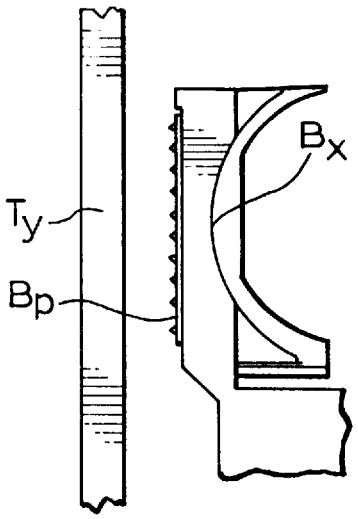
Figure 6M:
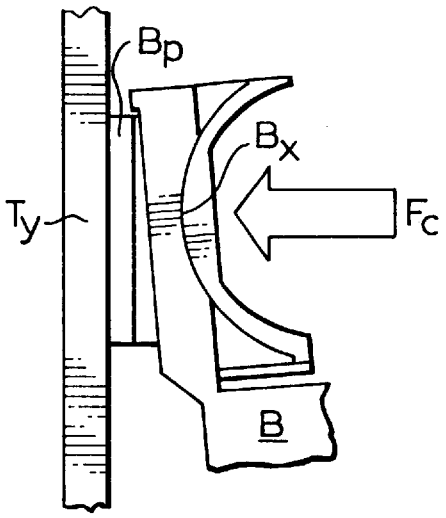

To ensure the positive braking action of the system and referring to FIGS. 6k,L, and M there is provided a recess in the side of the shoe B proximate the track Ty, The recess By1 including a generally rectangular perimeter for reception of the braking element Bp. Proximate the rear of recess By1 is provided a generally arcuate portion Bx which in use contacts portion Bp1 along the edge thereof as best seen in relation to FIG. 6L and M. The contact is made tangentially to the braking element Bp which floats in the recess By1 to ensure the orientation thereof in relation to the surface of the track Ty being engaged. As best seen in FIG. 6M when a force Fc is provided from the cam the locking portion of the shoe as described in relation to FIG. 6G including the arcuate portion Bx engages the braking element Bp at the braking surface thereof to engage the pebbles P1 with the surface of the track Ty, The arcuate portion ensuring the orientation of the brake element Bp in a plane substantially aligned with the surface of the track being engaged.

Referring now to FIGS. 14 through 21 there is illustrated a pivot shoe indicated generally as 100 being generally rectangular in shape. The shoe 100 has a carrier portion 110 having rollers disposed proximate the bottom thereof. Affixed to one end of the carrier portion 110 of shoe 100 is a clamping portion 120 which is connected to the body of the carrier by a flexible thin portion 121 and a fastener F1. The clamping portion 120 includes recesses 131 which carries braking elements 130 the use of which has been described above. The use of braking element 130 is analogous to the previous description of FIGS. 6F,G,H and I. The braking surfaces 130 are carried in the recess 131 disposed with portion 122 which is attached via the thin flexible portion 121 to allow flexing of the brake surfaces, the use of which will be described hereinafter.

A moveable clamping portion 160 is disposed within an opening 125 separating the two portions 122 carrying the braking surfaces 130. The clamping portion 160 is manufactured from glass filled nylon in order to ensure the strength thereof. Glass filled nylon finds particular application with the clamping surfaces because of the clamping surfaces improved resistance to creep under the pressures developed over nylon alone or plastic materials. The balance of the shoe may be made from less hardy materials provided the materials subjected to loads will not creep and lessen the performance of the unit. The clamping member 160 includes clamping flanges 165 which clamp flanges 175 of track 170 between clamping element 165 and braking surface 130. In order to move the clamping member up and down so as to provide the clamping action of the flanges 175 between element 165 and element 130, a handle portion 140 is provided which operates within the opening 125 of the clamping portion 120. Disposed at one end of the handle 140 is a cam portion 150 having an offset mounting as best seen in relation to FIG. 17 and being carried within openings 161 of the clamping member 160 and openings 132 of clamping element 122 by offset pins 151. The offset pins are allowed to travel within openings 132 as a result of the cam surface 152 abutting the opening 161 of clamping portion 160 and pushing it in a vertical direction so as to move the clamping flanges 165 towards and away from the flanges 175 of track 170.

Figure 18:
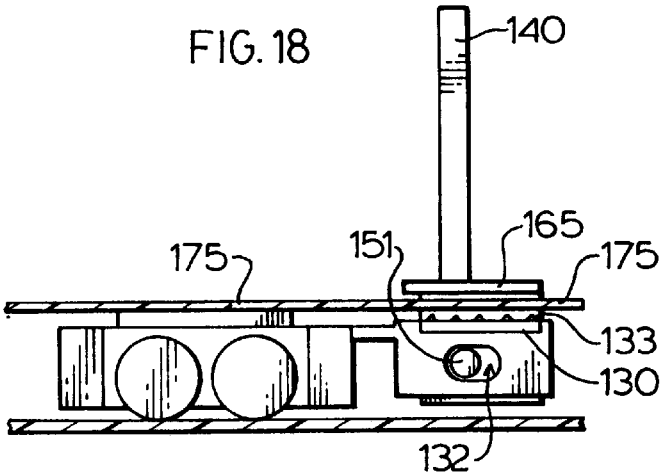
FIG. 18 is a closeup schematic view of the shoe installed in a window assembly of FIGS. 15 and 16.
Figure 19:
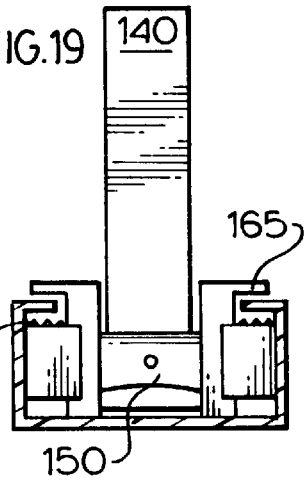
FIG. 19 is an end view of FIG. 18.
Figure 20:
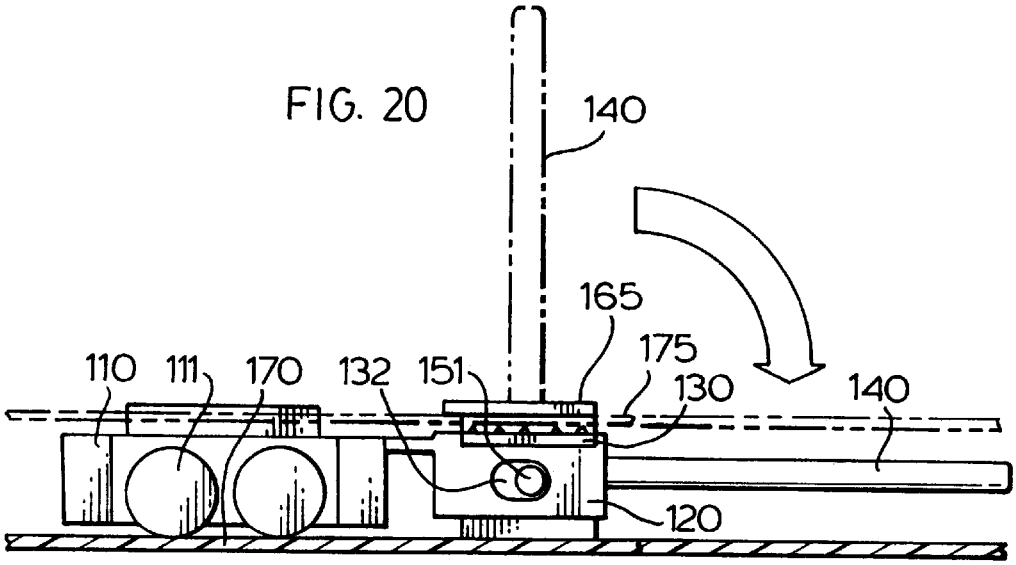
FIGS. 20 and 21 are identical views to FIG. 18 and 19 with the exception in the position of handle 140 shown in the locked position.
Figure 21:
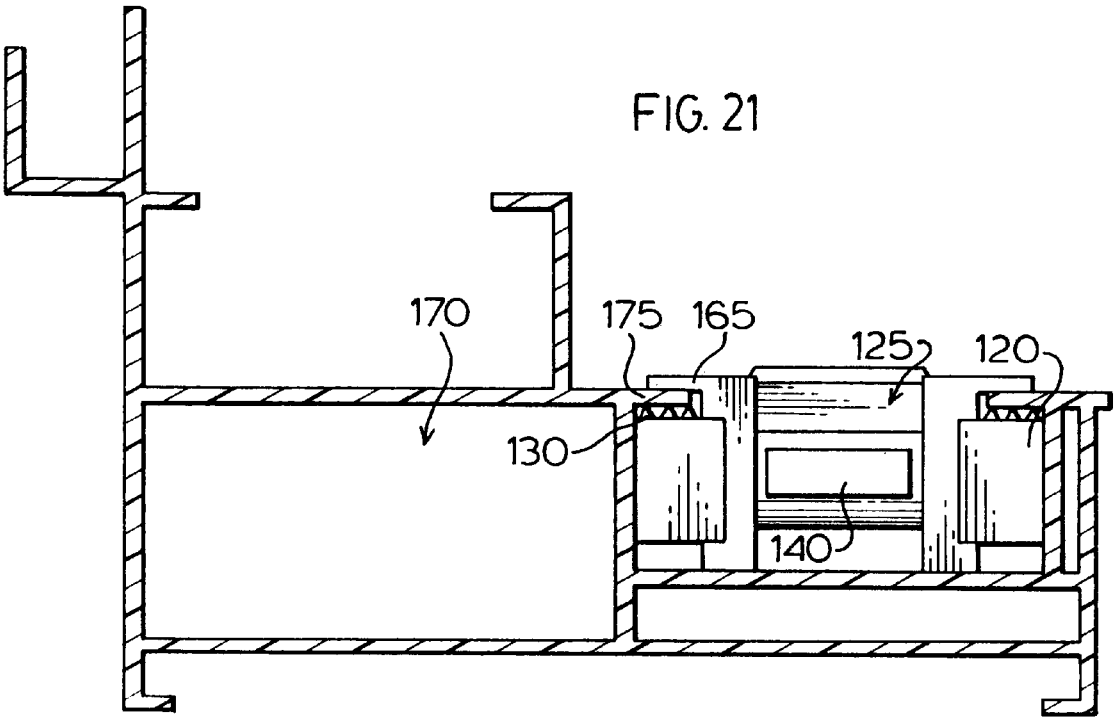

The seperation between the braking surfaces 130 and the clamping flanges 165 is sufficient to allow free unrestrained motion of the shoe in the track 170 until such time as the handle 140 is moved from the position illustrated in FIG. 18 to a position illustrated in FIG. 20. In moving the handle 140 the cam 150 is moved as well to allow the cam surface 152 to push downward on the clamping element 160 via openings 161 and to clamp the flange 175 of the track 170 between the clamping element 165 and the braking element 130. The braking element is provided only on the bottom of the track as the use thereof tends to pit the flanges 175 which are invisible on the bottom of the flanges 175. If the braking elements 130 are left out of the structure it is recommended that the braking surface 130 be formed from materials such as glass filled nylon to prevent creeping action of the surfaces under the clamping pressure.

Figure 15:
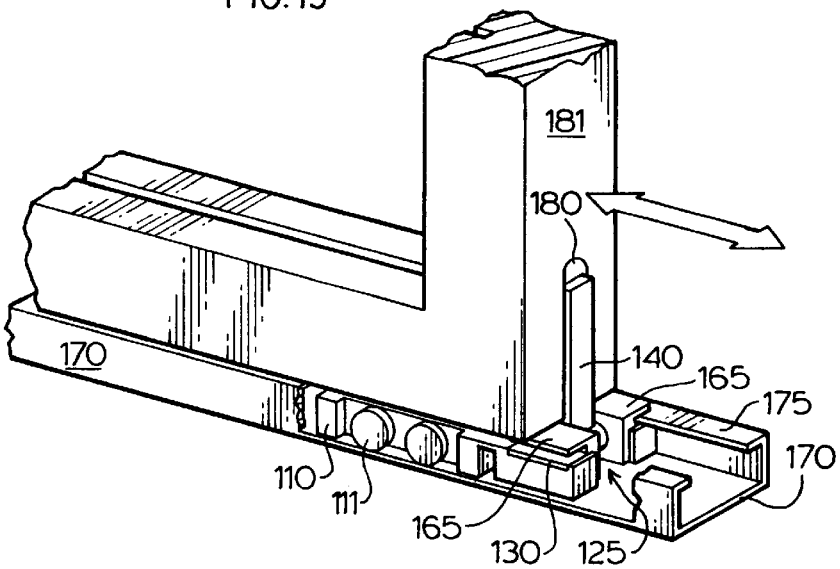
FIGS. 15 and 16 are partial perspective views cut away in part to illustrate the incorporation of the pivot shoe of FIG. 14 therein illustrated in a preferred embodiment of the invention.
Figure 16:
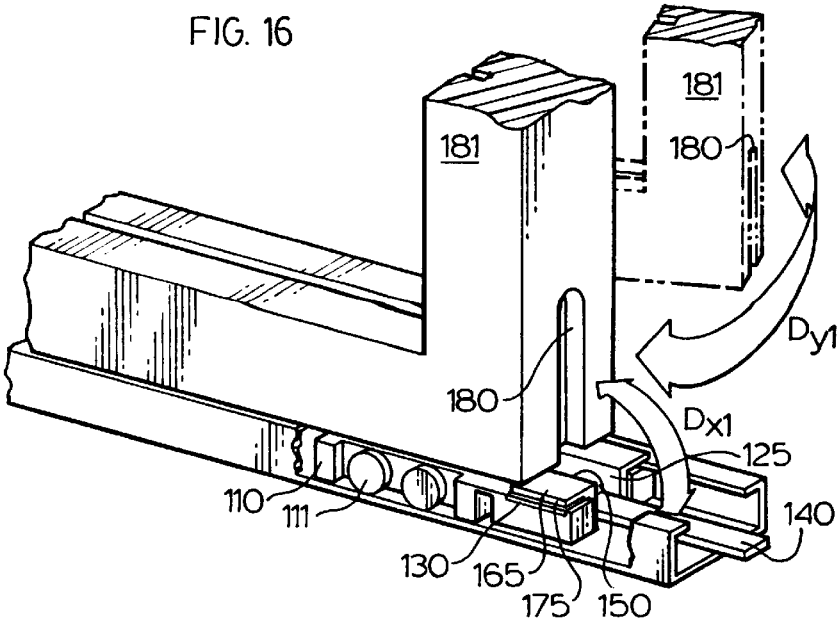

The handle 140 has a second purpose as best seen in relation to FIGS. 15 and 16. The closure member 181 includes a sash retainer portion 180 therewith to receive the handle 140 when the handle is in the position illustrated in FIG. 14. Therefore when the shoe 100 is not locked to the flanges 175 and the window 181 can slide in the track in the direction shown similar to the operation described in relation to FIG. 7A and 7B. When the handle 140 is released from the retainer 180 and generally in the position illustrated in FIG. 16 then the flanges 175 are clamped between elements 165 and 130 of the shoe 100 and the closure member is free to rotate or pivot away from track 170 in a direction Dy1.

Figure 22:
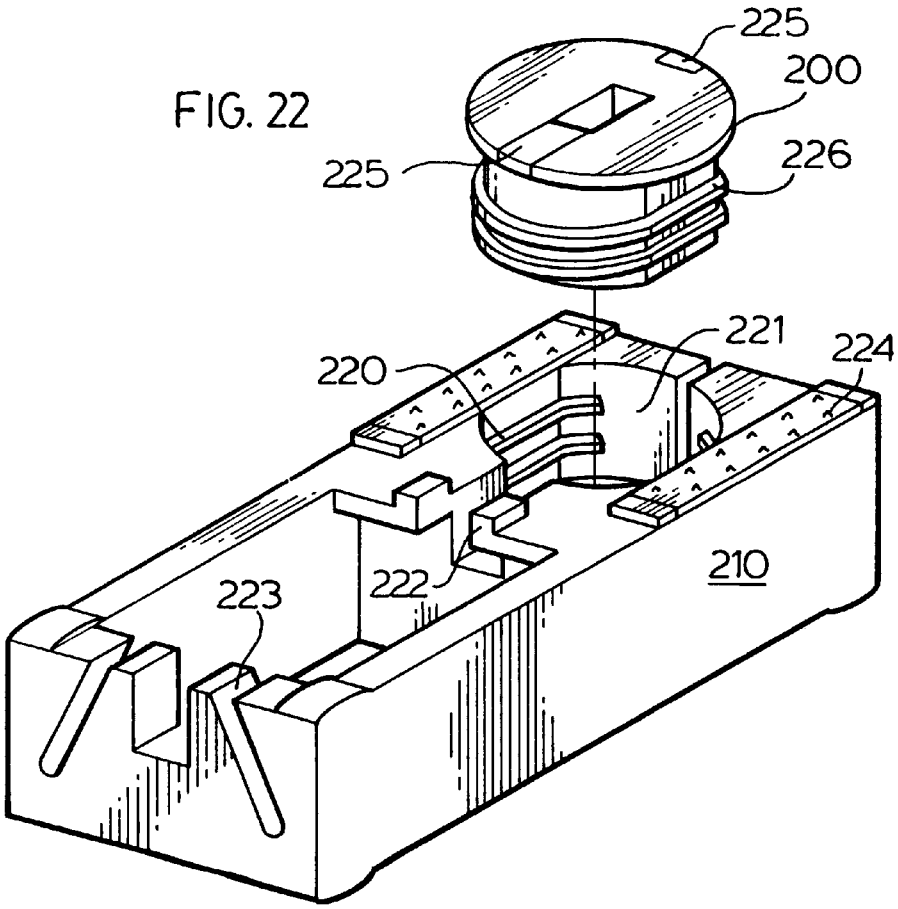
FIG. 22 is an exploded view of a cam installed in a pivot shoe for a double hung window assembly illustrating the clamping portions illustrated in a preferred embodiment of the invention.
Figure 22A:
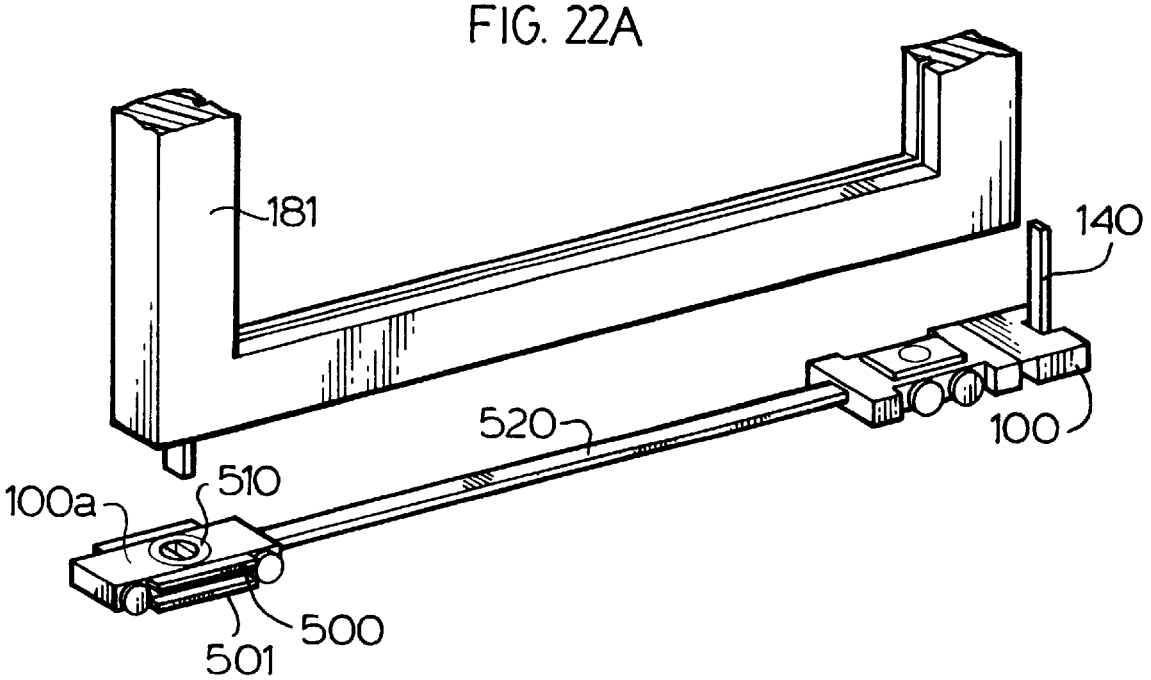
FIG. 22A and B are a schematic views of a pivot shoe and components thereof including clamping portions for use with a pivot of a closure assembly similar to FIG. 7A illustrated in an alternative embodiment of the invention.
Figure 22B:
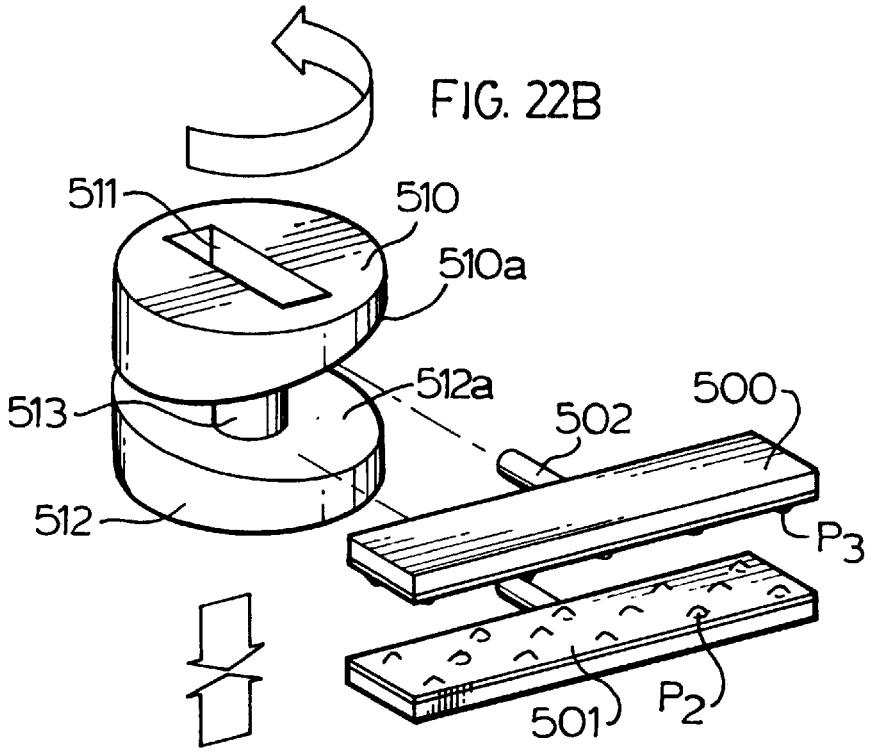

Referring now to FIGS. 22A and 22B there is illustrated a pivot shoe 100 as described above interconnected with a pivot shoe 100 (*a*), interconnected for the same advantages as described in relation to FIG. 7A etc. Provided with the shoe 100(*a*) is a cam portion 510 which is engaged to the pivot pin 181(*a*) via the opening 511. When the handle 140 is disengaged from the sash retainer 180 of closure member 181 then the window is free to pivot away from the track (not shown). In pivoting as with the structure of FIGS. 6G and 9, the cam will cause the braking elements 500 and 501 to move towards one another thus capturing the flange 175, not shown, and securing the closure member in the track.

Cam portions 510 and 512 have oppositely oriented ramp surfaces 510(*a*) and 512(*a*) disposed therewith upon which the pins 502 ride to cause the motion of the braking elements towards and away from the flange 175, not shown. Because of the presence of brake pads including pebbled portions P2 and P3 this structure may be used with aluminum window assemblies.

Referring to FIG. 22 there is illustrated a pivot shoe 210 used for a double hung window assembly as illustrated in FIGS. 3 and 4. This shoe 210 incorporates the clamping action previously described in relation to track 170 at flange 175. Of course however the structure is modified to be incorporated in a double hung window. A cam portion 200 is provided in the shoe 210 having a slot 201 disposed with the shoe to receive the pivot pin of the window. When the cam is in the position shown in FIG. 22 then the pin cannot be released. The cam 200 is disposed in an opening 221 in the shoe 210. The opening has disposed about it's perimeter an interupted thread 220 which if continuous would describe a helical thread. The cam portion 200 has mating threads 226 disposed therewith to mate with the threads 220 of the shoe 210. Brake shoe elements 224 are provided for similar use as previously described. A balance slot 223 is provided with the shoe which is provided at the end of the shoe opposite the cam 200. Guides 222 allow for ease of assembly.

The cam 200 includes clamping surfaces 225 which clamp the flanges 175 between itself and braking elements 224 when the cam is rotated by the action of the window pivoting. The helical threads on the cam 226 and the shoe 220 allows for the vertical motion of the clamping surfaces 225 in relation to the braking surfaces 224 when the cam is rotated. Therefore the braking surfaces 225 are rotated in and out of orientation with the braking surfaces 224. When the braking surfaces 225 and 224 are parallel to one another then flange 175, not shown, is clamped and thus the window locked only when the window is pivoted away from the track as seen in FIG. 4. When the window is in the track as shown in FIG. 3, then the surfaces 225 and 224 are not oriented so as to provide clamping action, but are separated.

Figure 23A:
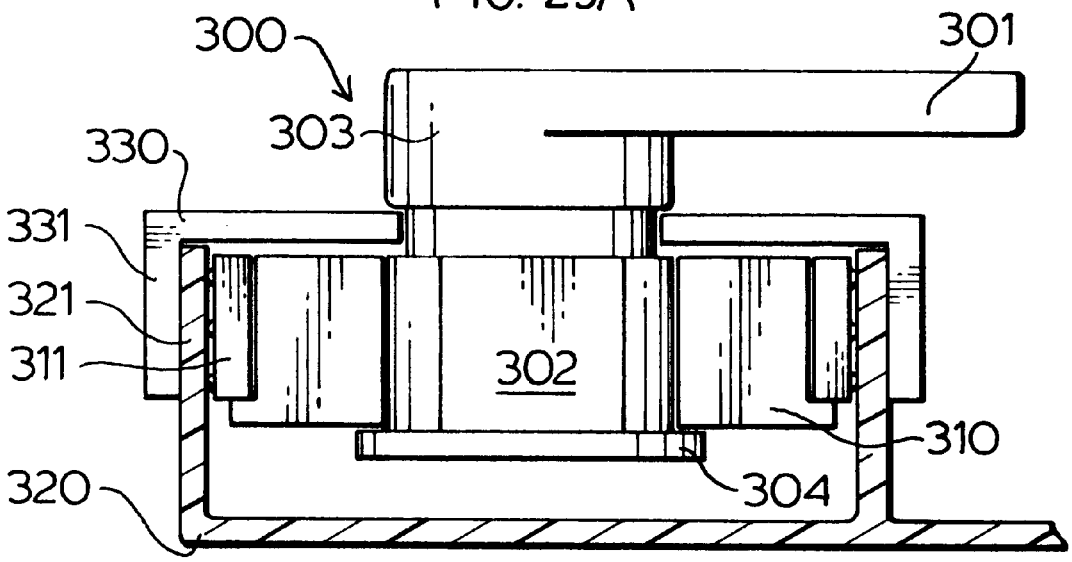
FIGS. 23A and B are cutaway elevation views of alternative embodiments of the invention incorporating clamping portions.
Figure 23B:
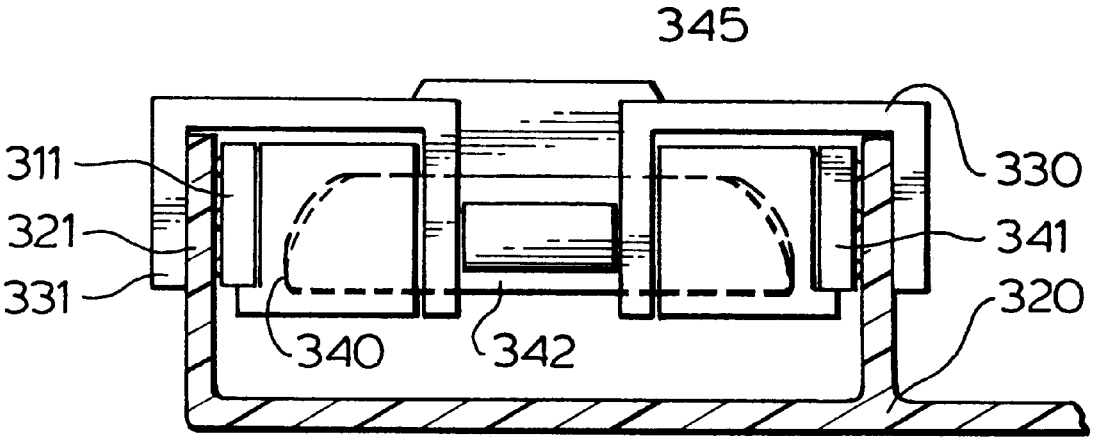

Referring now to FIGS. 23A and 23B there is illustrated an alternative embodiment of the invention when the track 320 does not have flanges similar to 175 provided therewith and it is still desirable to clamp the upwardly extending flanges 321. Therefore a shoe 300 is provided which includes a cam portion 303 which is anchored in an opening 302 of the shoe 300 by rim portions 304 to retain the cam 303 in the opening 302. A handle 301 is integrally provided with the shoe similar to the handle of FIG. 7A at the end of the window opposite the pivot. By turning the handle in FIG. 23A or by pivoting the window on pin 345 of FIG. 23B the cam portion 300 and 340 respectively will rotate causing portions 310 and 340 to spread and cause brake pads 311 to engage the side of the track 321 braced by the clamping portion 331 to clamp between 331 and 311 the flange 321. The clamping portion 330 is made from glass filled nylon for the same reasons set out above. the portion 330 is fixed in position and does not move in relation to the assembly being fixed on the shoe by portions 346 as best seen in relation to FIG. 23B.

Figures 24A, 24B:
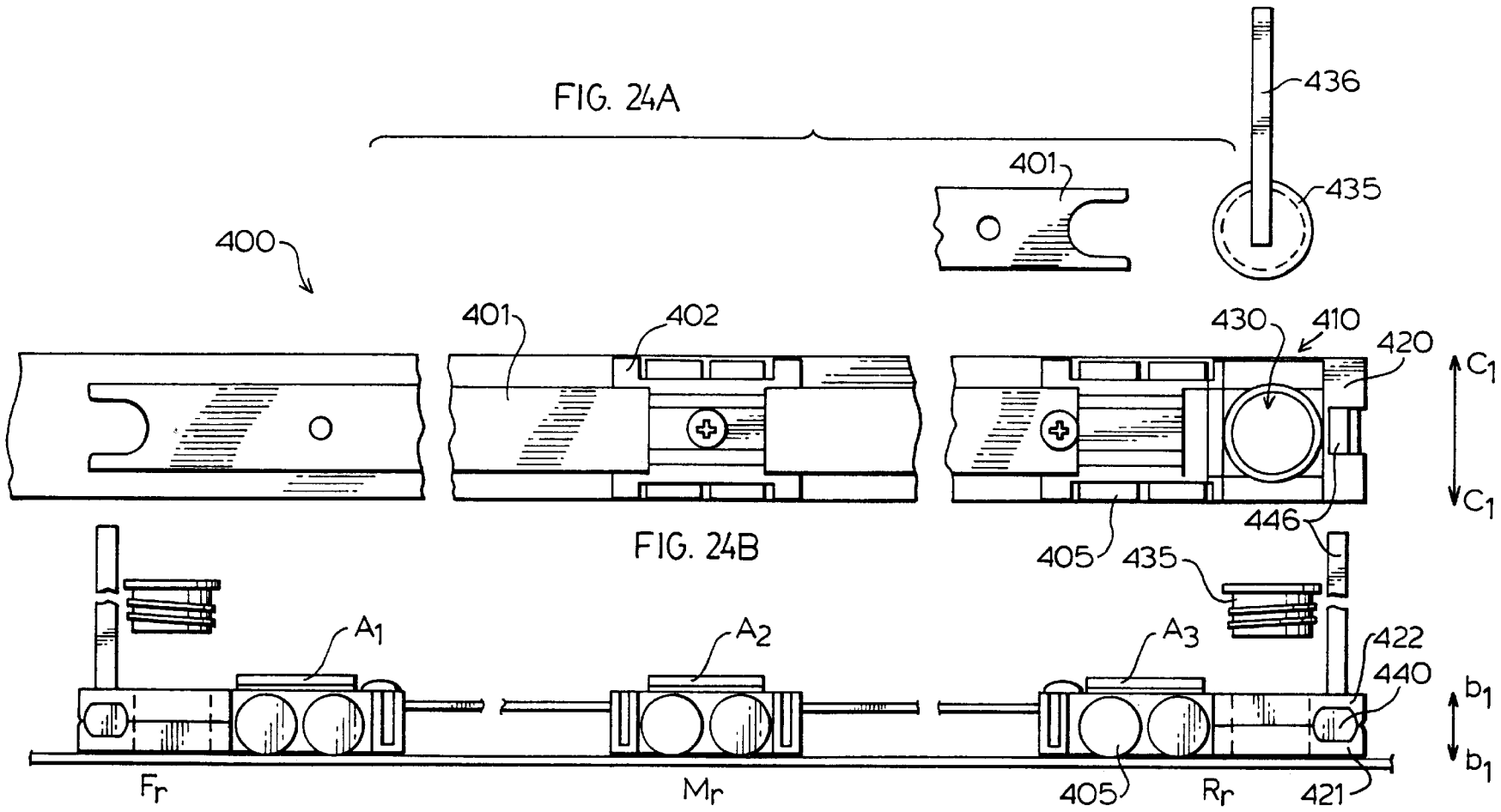
FIGS. 24A, 24B and 25 are schematic views of track portions of a closure assembly in which pivot shoes incorporating alternative embodiments of the invention are illustrated.

Referring now to FIGS. 24A,B and 25 there is illustrated an alternative embodiment of the invention which provides double locking action of a pivot shoe. Therefore the structure shown will lock the shoe in position when the window is parallel to the track and also when the window is moved away from the track as described in relation to FIG. 6I. The structure of FIG. 6I is incorporated to provide a lock which engages the sides of the track when the window is pivoted and which may provide security locking of the window in any of it's sliding positions except when fully closed.

Shoes A1, A2, and A3 are therefore provided which are interconnected by portion 401 for the reasons already described. Rollers 405 are provided with the shoe. Cam portions 435 are provided which operate as previously described. For example a handle 436 is provided to engage the action of the cam 435.

Figure 17:
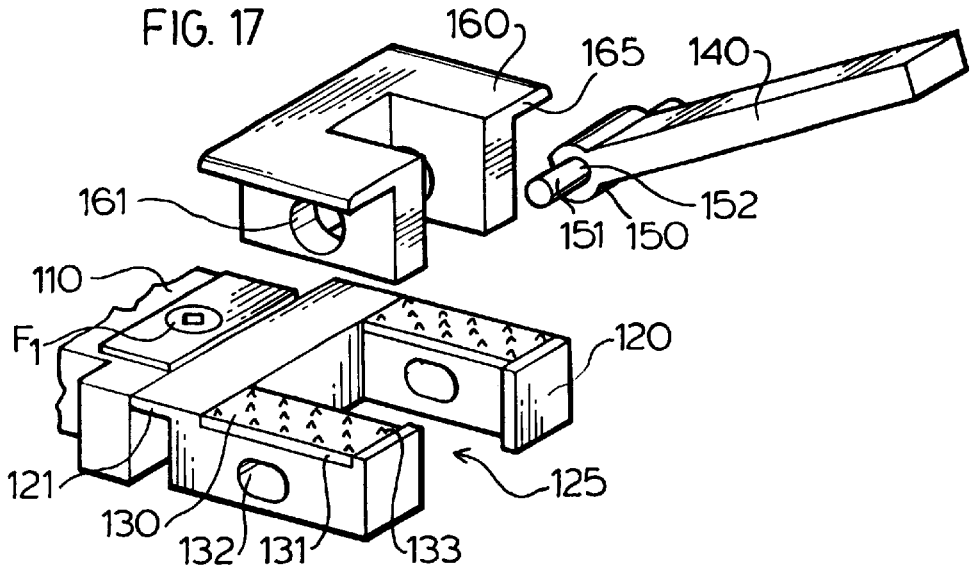
FIG. 17 is an exploded perspective view of the pivot shoe of FIG. 14 illustrating the interrelationship of the parts thereof.

Referring to FIG. 24B a handle 446 is provided similar in construction to handle 140 of FIG. 17, and having a cam 440 at one end. The handle 446 is held in a sash retainer WR when the window is free to slide. When the handle is pushed down to the locked position then the window can not slide. This is because the cam 440 causes the portions 422 and 421 to press against the top and bottom of the rail which includes portions 175 as illustrated in FIG. 17. In essence therefore the operation is similar to the operation of the structures of FIG. 7A with the exception that the security locking is provided against the top and bottom of the track. Alteratively a more complex handle arrangement may be provided to ensure that the sash retainer is still engaged when the security lock is engaged.

Figure 25:
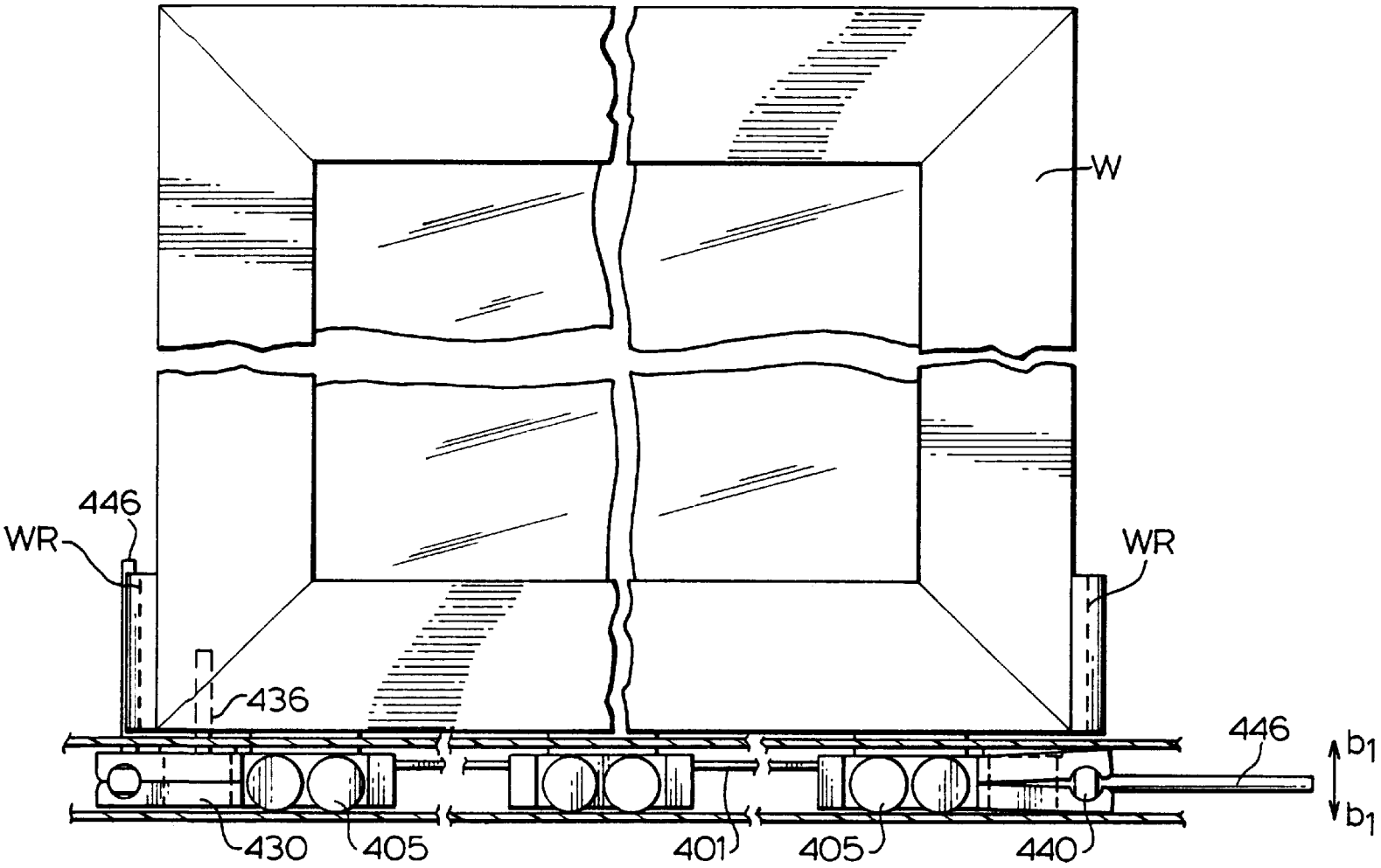
Figure 26:
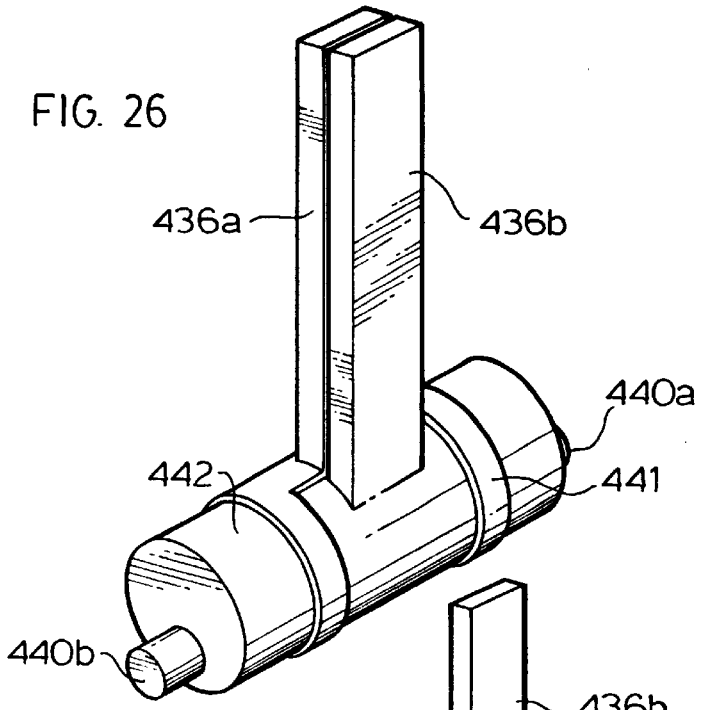
FIGS. 26 through 31 are schematic views of an alternative embodiment of the invention.
Figure 27:
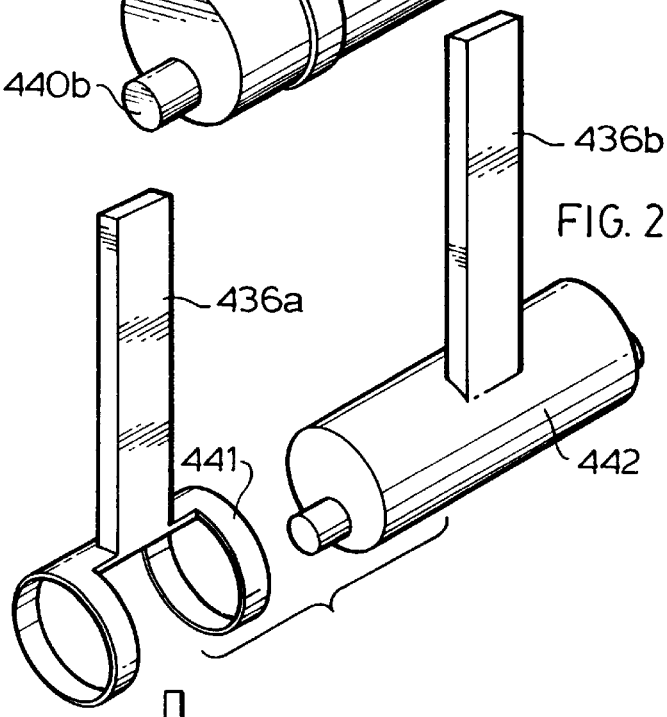
Figure 28:
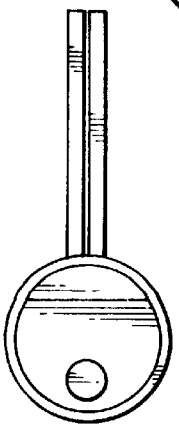
Figure 29:
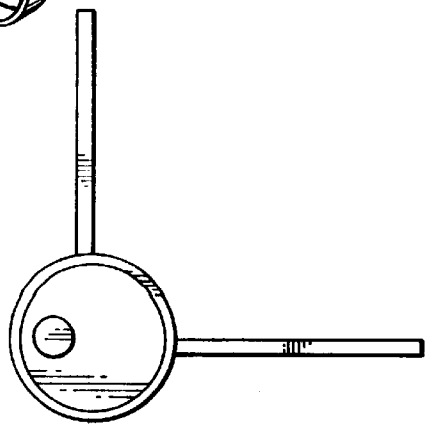
Figure 30:
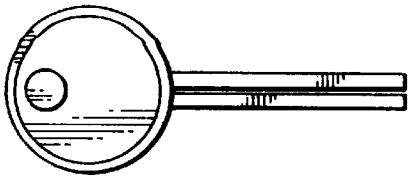
Figure 31:
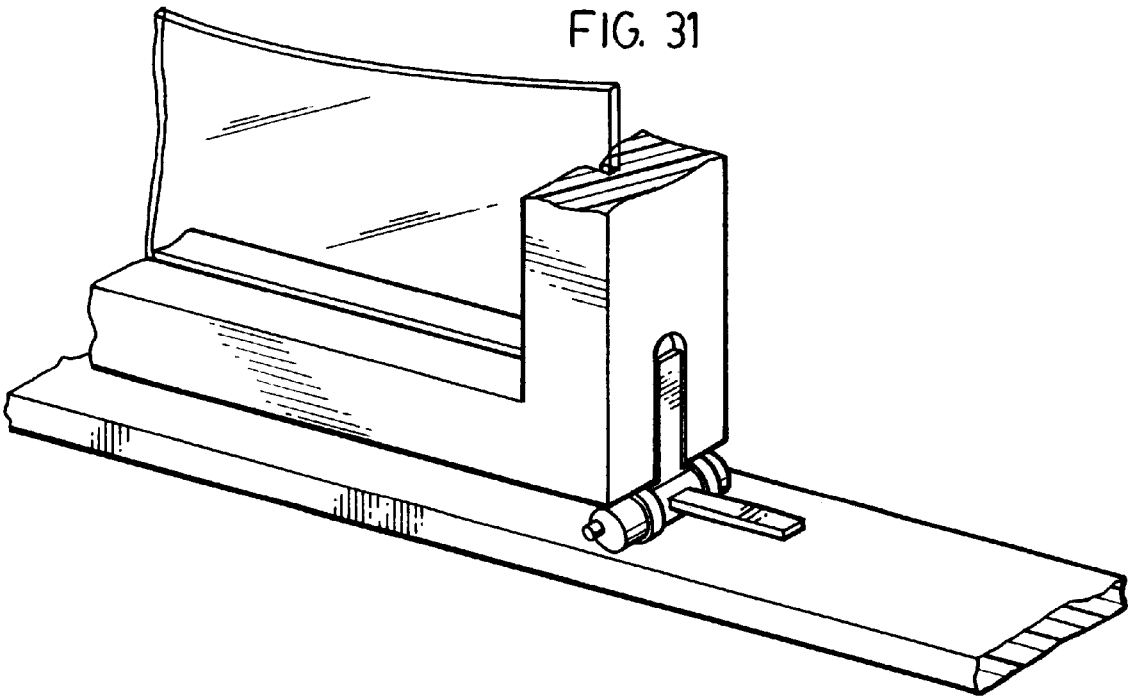

Therefore as illustrated in FIGS. 26 to 31 a double handled unit is provided for inclusion into the structures of FIGS. 24A, 24B, and 25 and specifically in the position shown with respect to the pivot shoe A3. Two components 441 and 442 make up the cam assembly 440 which can move simultaneously or separately. If both the handle portions 436*a* and *b* are contained within the sash retainer as exemplified by FIG. 28 then the window is not locked. In the position of FIG. 29 and 31 the window cannot slide, the security lock having been engaged by motion of handle 436*b* while the window is retained in the sash retainer by handle 436*a*. In FIG. 30 the window is free to pivot but may lock by cam 435 as previously described.

As many changes can be made to the preferred embodiments of the invention without departing from the scope or intent thereof; it is intended that all matter contained herein be considered as illustrative of the invention and not in a limiting sense.

The embodiments of the invention in which an exclusive property or privilege is claimed are as follows:

1. For a closure assembly having a moveable closure member provided in a track for movement along the track, the track having a bottom and having disposed therewith laterally extending flange portions extending substantially parallel to the bottom of the track, a carrier comprising means for mounting the closure member characterized by releasable clamping portions adapted to receive therebetween and releasably to clamp the laterally extending flange portions of the track in use, and operating means moveable in use when the carrier is installed in a closure assembly between an unlocked first position and a locked second position wherein proximate the first position at least one clamping portion is spaced away from another clamping portion so that when installed in a closure assembly the laterally extending flange portion of the track is released whilst remaining between the clamping portions, and at proximate the second position when installed in a closure assembly at least one clamping portion is moved toward said other clamping portion to clamp the laterally extending flange portion of the track and prevent movement of the closure member along the track, wherein when the carrier is installed in the closure assembly the laterally extending flange portion of the track remains between the clamping portions at all times whether the clamping portions are in the first or second positions irrespective of the manufacturing tolerances of the track.

2. The carrier as claimed in claim 1, wherein when the carrier is installed in the closure assembly the track has two flange portions extending towards each other, and the carrier comprises two pairs of clamping portions.

3. The carrier as claimed in claim 1 or claim 2, wherein the operating means comprises a cam rotatable about an axis which when installed in the closure assembly is disposed substantially in the plane of the closure member and substantially perpendicular to the extent of the track, the cam having an inclined surface to move at least one clamping portion in the direction of said axis to effect clamping.

4. The carrier as claimed in claim 1 wherein the operating means comprises a cam rotatable about an axis which when installed in the closure assembly is disposed substantially perpendicular to the extent of the track and to the plane of the closure member, the cam having camming surfaces to move at least one clamping portion radially of said axis to effect clamping.

5. The carrier as claimed in claim 1 or 2, wherein when the carrier is installed in the closure assembly the closure member is pivotable, the operating means comprising a cam portion and a lever portion, the operating means in use being moveable between, a first position in which the lever engages the closure member to prevent pivoting thereof and the track flange portion is unclamped, and a second position in which the lever disengages from the closure member to permit pivoting thereof and the cam portion operates the clamping portions to clamp the track flange portion.

6. The carrier as claimed in claim 1, wherein said clamping portion further comprises a brake pad adapted in use when the carrier is installed in a closure assembly to bear upon a side surface of the laterally extending flange of the track portion facing away from the closure member.

7. The carrier of claim 1 further comprising interconnected first and second carriers.

8. For a closure assembly having a pivotable closure member disposed in a track and for movement along the track, the track having disposed therewith laterally extending parts, a carrier comprising means for mounting the closure member characterized by clamping portions adapted to receive and releasably clamp therebetween in use when the carrier is installed in a closure assembly, the laterally extending part of the track, and operating means comprising a cam portion and a lever portion, the operating means being moveable in use when the carrier is installed in a closure assembly between a first position in which the lever engages the closure member to prevent pivoting thereof and the laterally extending track part is unclamped, and a second position in which the lever disengages from the closure member to permit pivoting thereof and the cam portion operates the clamping portions to clamp the laterally extending track part.

9. The carrier as claimed in claim 8, wherein said clamping portion further comprises a brake pad.

10. A closure assembly comprising a track having parts and a pivotable closure member moveable along said track, the assembly having a first carrier engageable with the track and having means for supporting the closure member at a first region thereof for movement along the track and for pivotal movement away from the closure assembly, a second carrier engageable with the track and spaced from the first carrier to support the closure member at a second region thereof spaced form the first region for movement along the track, means interconnecting the first and second carriers, and characterized in that the first and second carriers each comprises releasable clamping portions which receive therebetween respective parts of the track and clamp said track parts when the closure member is pivoted, the clamping portions of the second carrier comprising operating means moveable between a first position in which said operating means engages the closure member to prevent pivoting thereof and the clamping portions of the second carrier are released, and a second position in which the operating means disengages from the closure member to permit pivoting thereof and said clamping portions clamp the track part therebetween.

11. The assembly of claim 10 wherein the first and second carriers are adjustably interconnected.

* * * * *